US012258702B2

(12) United States Patent
Lai

(10) Patent No.: US 12,258,702 B2
(45) Date of Patent: Mar. 25, 2025

(54) HANDHELD GARMENT CARE DEVICE

(71) Applicant: CONAIR LLC, Stamford, CT (US)

(72) Inventor: Kin Man Lai, Wu Kai Sha (HK)

(73) Assignee: Conair LLC, Stamford, CT (US)

( * ) Notice: Subject to any disclaimer, the term of this patent is extended or adjusted under 35 U.S.C. 154(b) by 47 days.

(21) Appl. No.: 18/069,607

(22) Filed: Dec. 21, 2022

(65) Prior Publication Data

US 2024/0209564 A1 Jun. 27, 2024

(51) Int. Cl.

| | |
|---|---|
| ***D06F 75/30*** | (2006.01) |
| ***D06F 75/18*** | (2006.01) |
| ***D06F 75/20*** | (2006.01) |
| ***D06F 75/26*** | (2006.01) |
| ***D06F 75/34*** | (2006.01) |

(52) U.S. Cl.

CPC ..... *D06F 75/30* (2013.01); *D06F 75/18* (2013.01); *D06F 75/20* (2013.01); *D06F 75/26* (2013.01); *D06F 75/34* (2013.01)

(58) Field of Classification Search

CPC ..... D06F 75/30; D06F 75/34; D06F 71/026; D06F 71/34; D06F 71/36

See application file for complete search history.

(56) References Cited

U.S. PATENT DOCUMENTS

| | | | | |
|---|---|---|---|---|
| 49,956 | A * | 9/1865 | Tucker | D06F 75/36 38/88 |
| 123,119 | A * | 1/1872 | Myers | D06F 75/34 38/80 |
| 7,121,024 | B1 * | 10/2006 | Clevenberg | D06F 71/32 38/25 |
| 8,375,610 | B2 * | 2/2013 | Bearley | D06F 71/34 38/144 |
| 8,763,283 | B2 | 7/2014 | Bearley et al. | |
| 9,181,651 | B2 * | 11/2015 | Bishop | A47G 25/72 |
| 10,081,905 | B2 * | 9/2018 | Herrild | D06F 75/30 |
| 11,168,439 | B1 * | 11/2021 | Toll | D06F 71/36 |
| 2006/0108344 | A1 | 5/2006 | Kim et al. | |
| 2010/0199528 | A1 * | 8/2010 | Fabrikant | D06F 71/32 38/77.8 |
| 2012/0102793 | A1 * | 5/2012 | Harrington | D06F 71/32 38/144 |
| 2014/0238432 | A1 | 8/2014 | Deng | |
| 2015/0233045 | A1 | 8/2015 | Dierker | |
| 2015/0327650 | A1 | 11/2015 | Fereyre | |
| 2016/0286928 | A1 | 10/2016 | Weatherly et al. | |

* cited by examiner

*Primary Examiner* — Nathan E Durham

(74) *Attorney, Agent, or Firm* — Ruggiero McAllister & McMahon LLC

(57) ABSTRACT

A handheld garment care device includes a first ironing surface and a second ironing surface that are orthogonally opposed, and independently used. A handheld garment care device also includes a first set of ironing heated surfaces where each surface is opposed to the other and can be closed toward each other, and a second set of one or more ironing heated surfaces where the one or more surfaces are not co-planar with any surface of the first set.

17 Claims, 21 Drawing Sheets

HANDHELD GARMENT CARE DEVICE

BACKGROUND

1. Field of the Disclosure

The present disclosure relates to a handheld garment care device. In particular, the present disclosure is related to a handheld garment care device that includes both a steamer and a creaser.

2. Description of Related Art

Garment care devices generally provide a single position for operation, namely, a steamer typically provides holes to emit steam and may also include a single soleplate to provide a hot contact surface to apply to fabric to flatten creases. Accordingly, if a user desires a different type of garment care beyond the capability of the single position for operation, then the user will need an additional device, which undesirably increases cost and takes up additional space. Further, the need for a second device generally requires more time needed for garment care.

Accordingly, it has been determined by the present disclosure that there is a continuing need for a device that overcomes, alleviates, and/or mitigates one or more of the aforementioned and other deleterious effects of prior devices.

SUMMARY

The present disclosure provides a handheld garment care device that includes a first ironing surface and a second ironing surface that are orthogonally opposed, and independently used.

The present disclosure also provides a handheld garment care device that includes a first set of ironing heated surfaces where each surface is opposed to the other and can be closed toward each other, and a second set of one or more ironing heated surfaces where the one or more surfaces are not co-planar with any surface of the first set.

The above-described and other features and advantages of the present disclosure will be appreciated and understood by those skilled in the art from the following detailed description, drawings, and appended claims.

DETAILED DESCRIPTION

Figure 3:
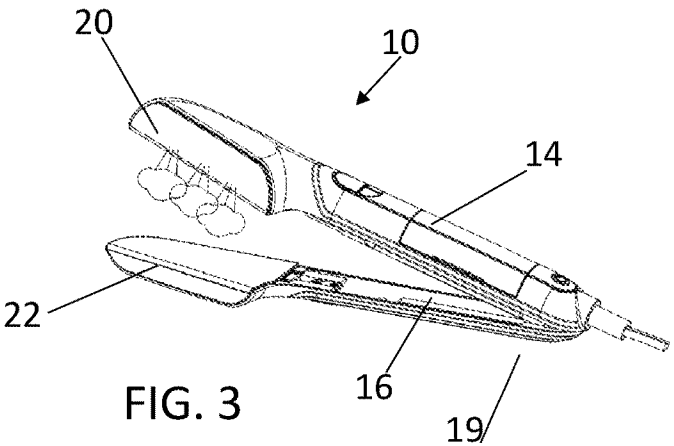
FIG. 3 is a side perspective view of the garment care device of FIG. 1 in a creaser configuration and in an opened position.
Figure 4:
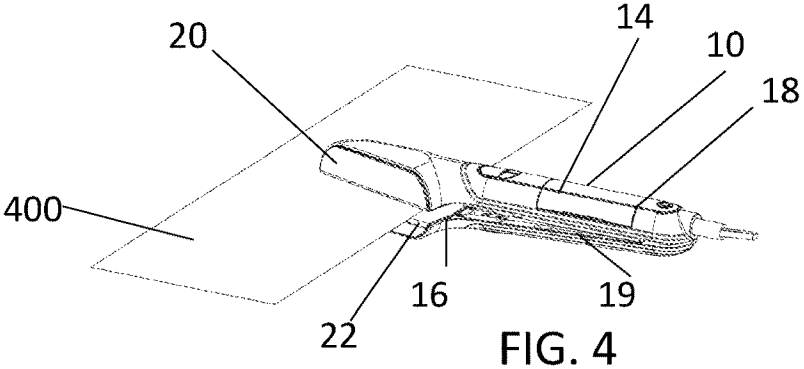
FIG. 4 is a side perspective view of the garment care device of FIG. 1 in the creaser configuration and in a closed position in contact with a fabric.
Figure 1:
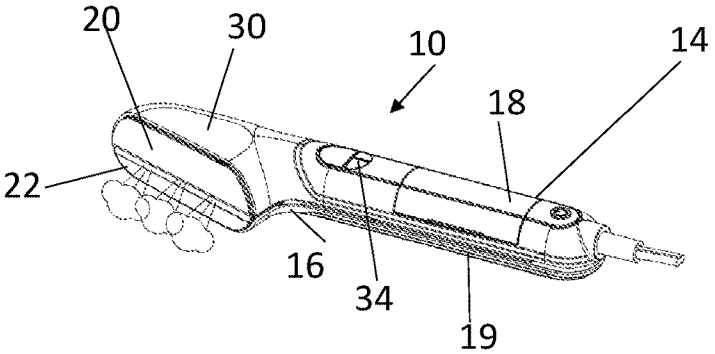
FIG. 1 is a side perspective view of a garment care device according to the present disclosure in a steamer configuration.
Figure 2:
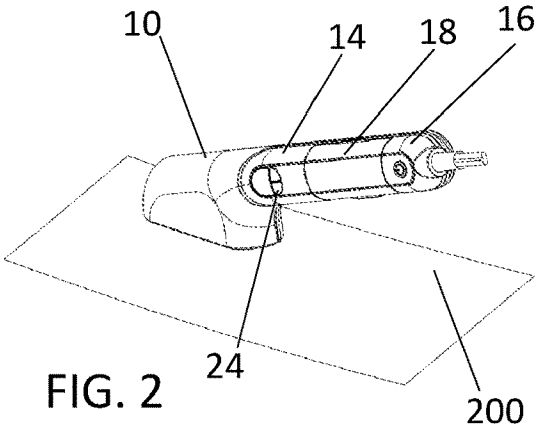
FIG. 2 is a side perspective view of the garment care device of FIG. 1 in the steamer configuration in contact with a fabric.

Referring to the drawings and in particular to FIG. 1, an exemplary embodiment of a garment care device according to the present disclosure is shown and is generally referred to by reference numeral 10 ("device 10"). Advantageously, device 10 is a handheld garment steamer for straightening creases in wrinkled fabric that provides a creaser configuration, as shown in FIG. 3, and a steamer configuration, as shown in FIG. 1, in a single device. Device 10 allows a user to push a locking button 12 (FIG. 6) to lock a first arm 14 and a second arm 16 together to hold handles 18, 19 while device 10 is turned on to use device 10 as shown in FIGS. 1 and 2 in the steamer configuration. Device 10 can be used as a dry iron, as shown in FIGS. 2 and 4, with a first soleplate 20 and a second soleplate 22 contacting a garment 200, 400 or press a steam button 34 to work as garment steamer with the steam spraying out from first soleplate 20 toward garment 200, 400, as shown in FIGS. 1 and 3. A further advantage of device 10 is that the user can unlock first arm 14 and second arm 16 after preheating by moving locking button 12, and, as shown in FIGS. 3 and 4, where a spring pushes first arm 14 and second arm 16 away allowing the user to hold handles 18, 19 and clamp a garment 400 to remove wrinkles with or without steam sprayed from a bottom of first soleplate 20 in the creaser configuration.

Figure 5:
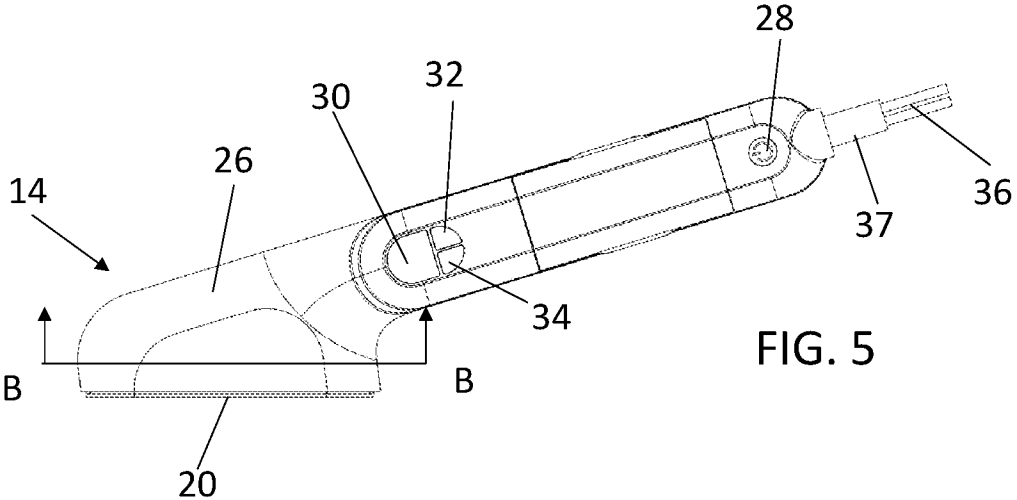
FIG. 5 is a right side view of FIG. 1.

Referring to FIG. 5, first arm 14 has a first arm housing 26 that is connected to first soleplate 20. First arm 14 has a power button 28 through first soleplate 20. First arm 14 also has a steamer/creaser indicator 30, an indicator and button 32 and a steam button with indicator 34 that each extend through first arm housing 26. A power cord 36 extends into first arm housing 26 through power cord sleeve 37 that is connected to first arm housing 26.

Figure 6:
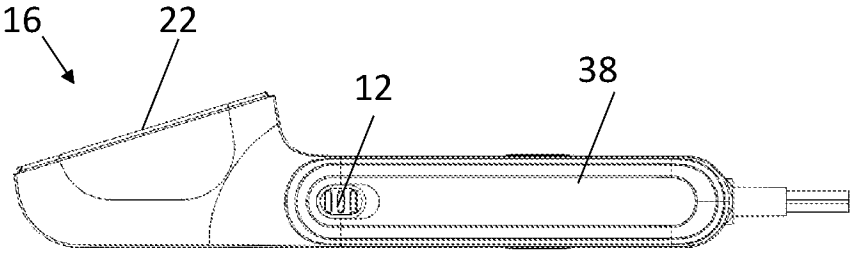
FIG. 6 is a left side view of FIG. 1.

Referring to FIG. 6, second arm 16 has a second arm housing 38 that is connected to second soleplate 22. Second arm 16 has a locking button 12 through second arm housing 38.

Figure 7:
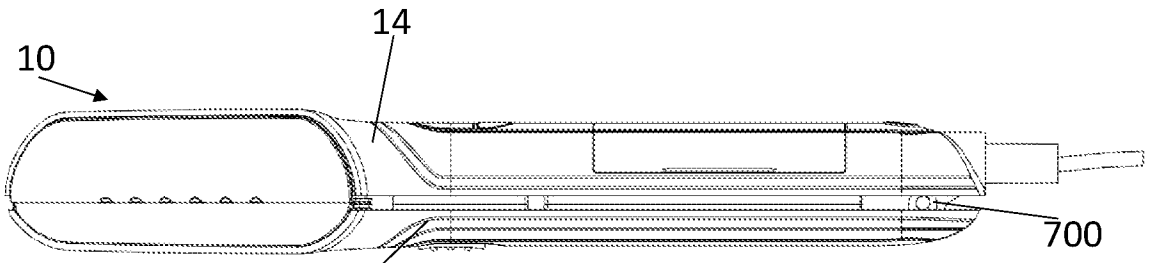
FIG. 7 is a bottom view of FIG. 1.
Figure 8:
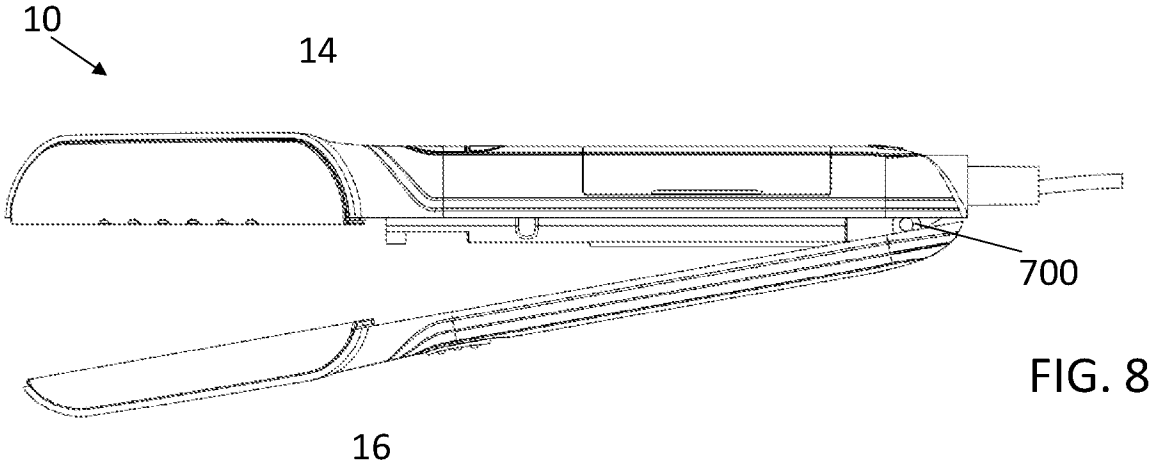
FIG. 8 is a bottom view of FIG. 2.
Figure 9:
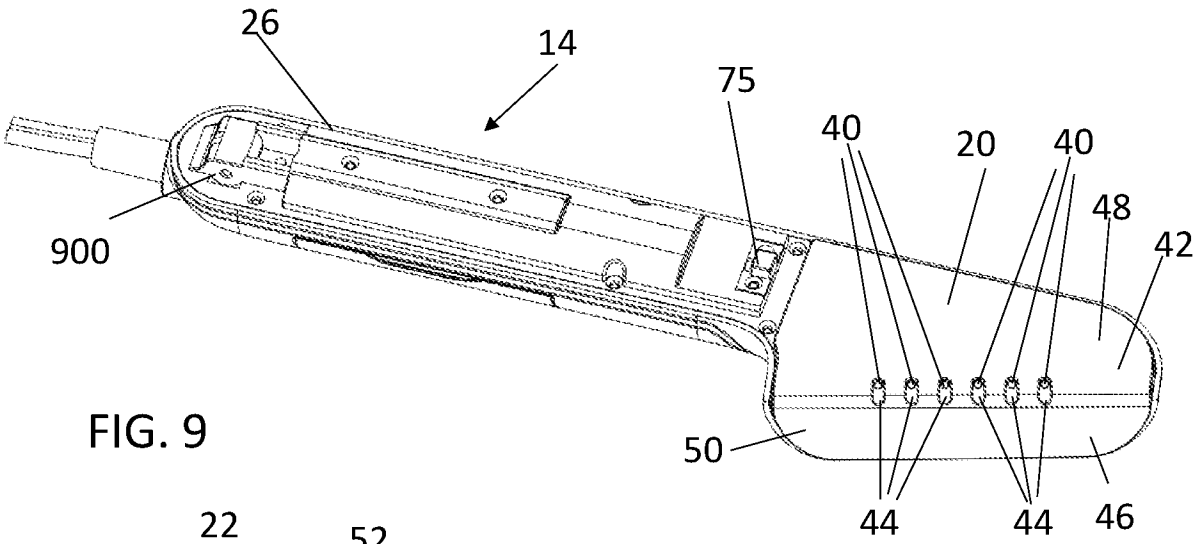
FIG. 9 is a side perspective view of a first arm of the garment care device of FIG. 1.
Figure 10:
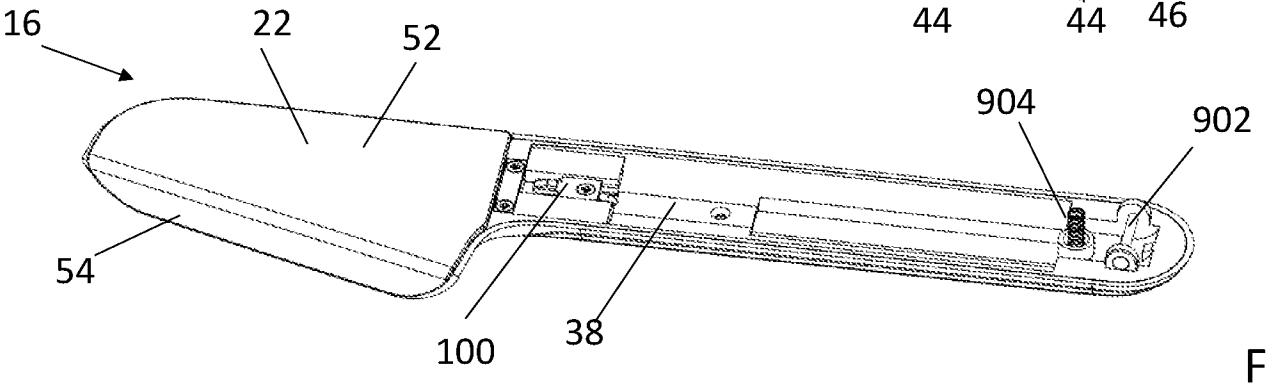
FIG. 10 is a side perspective view of a second arm of the garment care device of FIG. 1.

Referring to FIGS. 7 and 8, first arm 14 is connected to second arm 16 by a hinged connection 700. Referring to FIGS. 9 and 10, hinged connection 700 has a first hinged member 900 extending from first arm housing 26 of first arm 14 and hinged connection 700 has a second hinged member 902 extending from second arm housing 38 of second arm 16. First hinged member 900 is connected to second hinged member 902 to form hinged connection 700. A spring 904 extends from second arm housing 38 of second arm 16 to abut first arm housing 26 of first arm 14 when first hinged member 900 is connected to second hinged member 902 to form hinged connection 700 to bias first arm 14 away from second arm 16.

Still referring to FIGS. 9 and 10, first soleplate 20 and second soleplate 22 are designed for both the creaser configuration and the steamer configuration. First soleplate 20 and second soleplate 22 are each an L shape. First soleplate 20 has a first crease portion 48 and a first steamer portion 50 that form the L shape. Second soleplate 22 has a second crease portion 52 and a second steamer portion 54 that form the L shape. First soleplate 20 has steam holes 40 normal to a surface 42 through first crease portion 48. First soleplate 20 has grooves 44 normal to surface 46 formed in first crease portion 48 and first steamer portion 50. When device 10 is in the creaser configuration and in an opened position, as shown in FIG. 3, steam is sprayed out from steam holes 40 on surface 42. When device 10 is in the creaser configuration and in a closed position, as shown in FIG. 4, the garment is clamped to remove wrinkles by steam and hot surfaces of first crease portion 48 and second crease portion 52 as a garment creaser. When first arm 14 and second arm 16 are moved together to maintain the steamer configuration by a locked unit, steam is sprayed out from grooves 44 normal to surface 46 to reduce or remove wrinkles by the steam and hot surfaces of first steamer portion 50 and second steamer portion 54.

Figure 12:
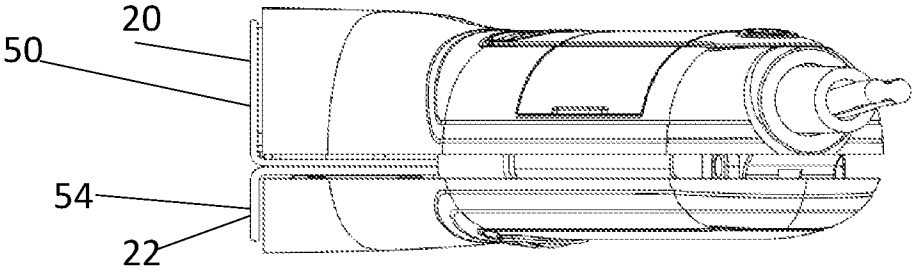
FIG. 12 is a rear perspective view of FIG. 1.
Figure 13:
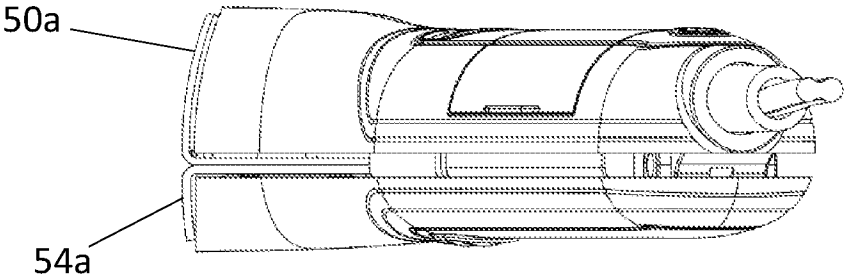
FIG. 13 is a rear perspective view of the garment care device of FIG. 1 in the steamer configuration that is modified to have the first soleplate and the second soleplate that each have surfaces that are curved.
Figure 11:
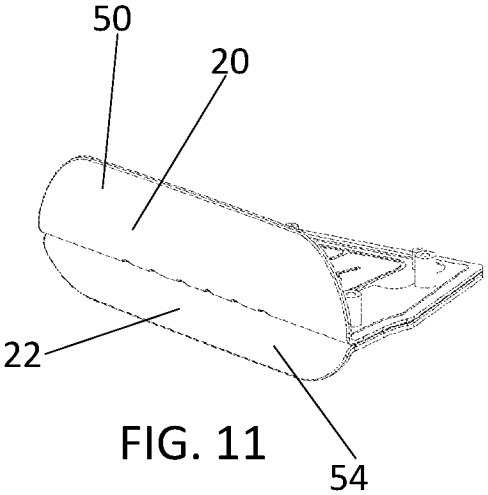
FIG. 11 is a side perspective view of a first soleplate and a second soleplate of the garment care device of FIG. 1.

Referring to FIG. 11, first soleplate 20 and second soleplate 22 form a two in one steam soleplate. As discussed above, first soleplate 20 and second soleplate 22 are designed for both the creaser configuration, as shown in FIG. 3, and the steamer configuration, as shown in FIG. 1. First soleplate 20 and second soleplate 22 are each an L shape. Referring to FIG. 12, first steamer portion 50 and second steamer portion 54 are flat surface. However, first steamer portion 50 and second steamer portion 54 can be a flat surface or modified to first steamer portion 50*a* and second steamer portion 54*a* that are curved surfaces, as shown in FIG. 13. An angle of first crease portion 48 and first steamer portion 50 is between about 60 about 150 degrees to form the L shape. The typical angle between first crease portion 48 and first steamer portion 50 is 90 degrees. An angle of second crease portion 52 and second steamer portion 54 is between about 60 about 150 degrees to form the L shape. The typical angle between second crease portion 52 and second steamer portion 54 is 90 degrees.

Figure 14:
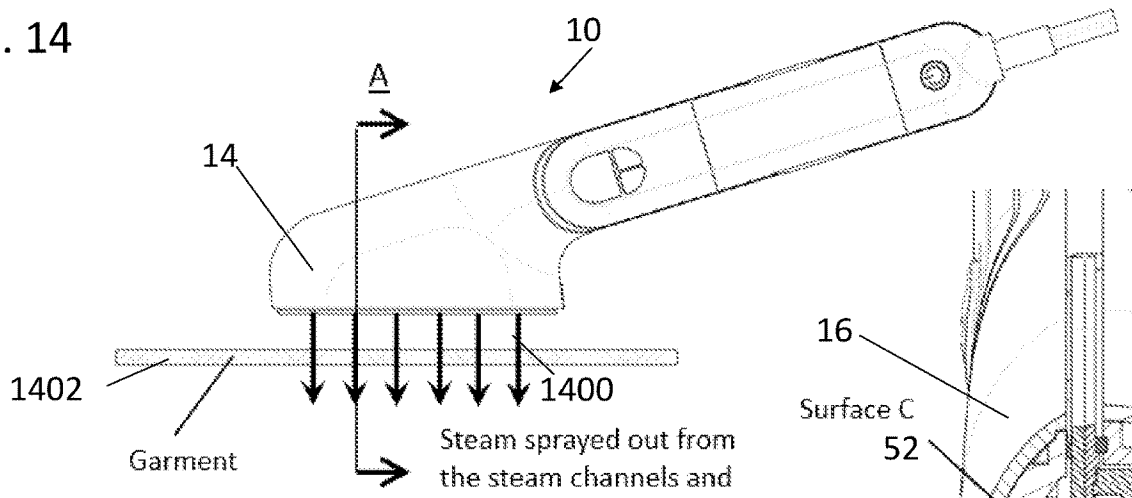
FIG. 14 is a side perspective view of the garment care device of FIG. 1 in the steamer configuration and a fabric having arrows showing a direction that steam is emitted.
Figure 15:
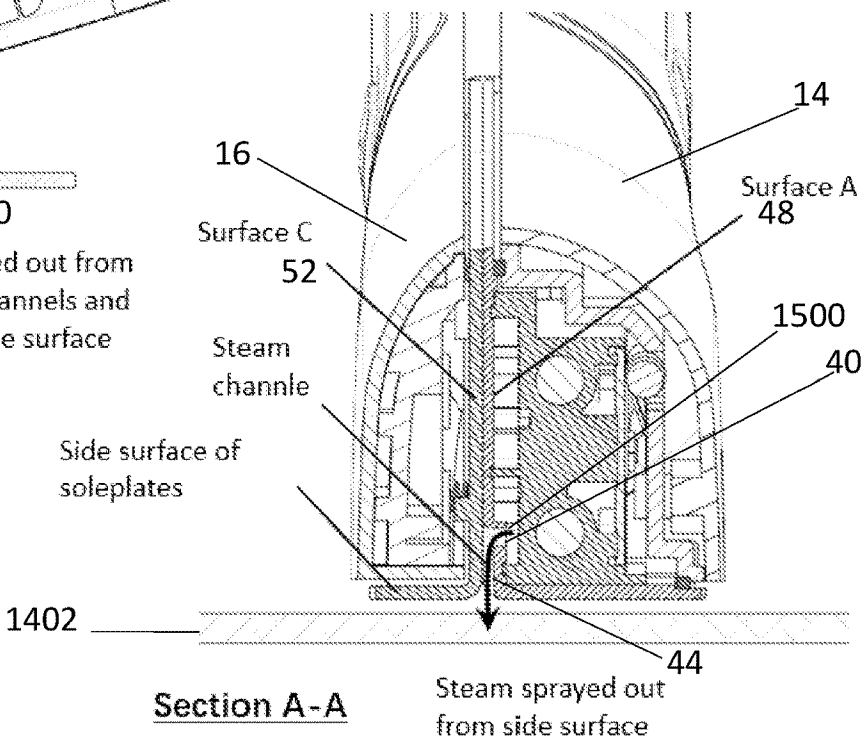
FIG. 15 is a partial front cross-sectional view taken along line A-A of FIG. 14 of the garment care device of FIG. 1.

Referring to FIGS. 14 and 15, when first arm 14 and second arm 16 are moved together to maintain the steamer configuration by a locked unit, first crease portion 48 and second crease portion 52 are pressed together, second crease portion 52 covers grooves 44 on first crease portion 48 to form steam channels, so that steam is sprayed out from one of steam holes 40 through one of the steam channels, as shown by arrow 1500 in FIG. 15, formed by second crease portion 52 covering grooves 44 and the steam is sprayed normal to first steamer portion 50 and second steamer portion 54, as shown by arrows 1400 in FIG. 14.

Figure 16:
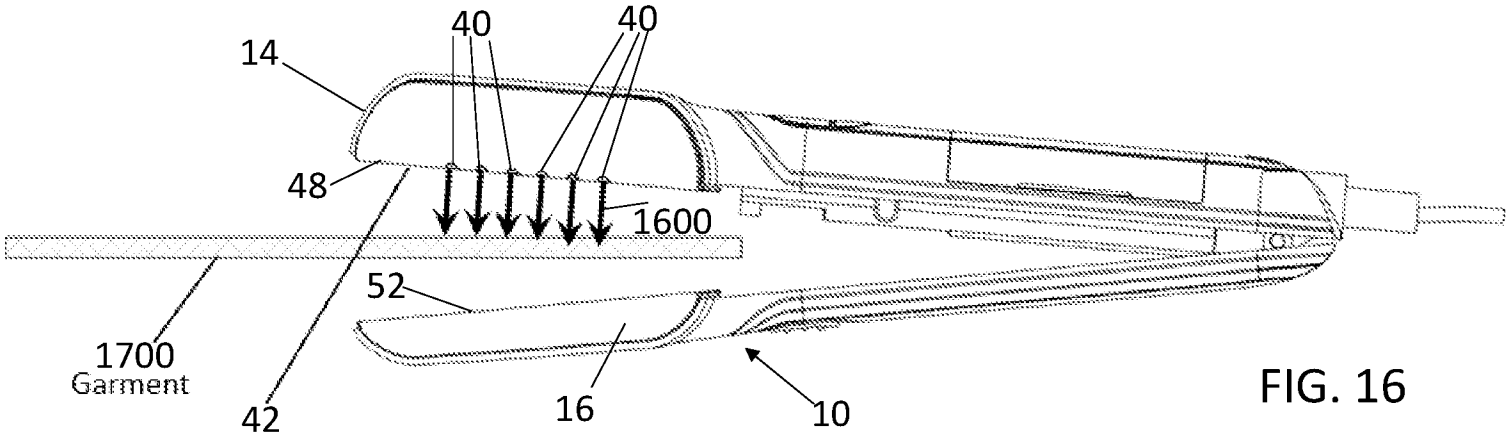
FIG. 16 is a side view of the garment care device of FIG. 1 in the creaser configuration and in the opened position on opposite sides of a fabric.
Figure 17:
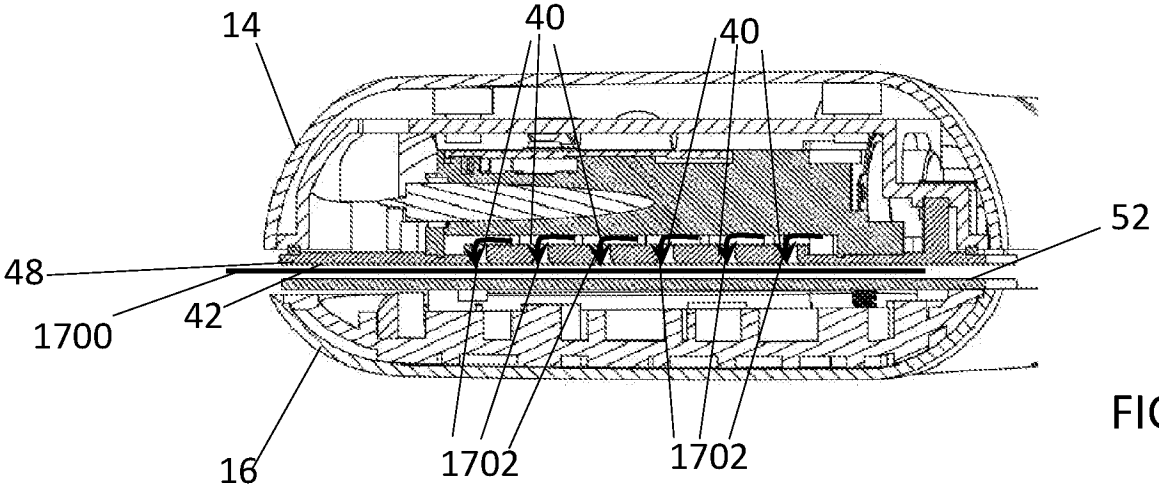
FIG. 17 is a partial side cross-sectional view of the garment care device of FIG. 1 in the creaser configuration and in the closed position in contact with a fabric having arrows showing a direction that steam is emitted.

Referring to FIGS. 16 and 17, when device 10 is in the creaser configuration and in an opened position, as shown in FIG. 16, steam is sprayed out from steam holes 40 on surface 42. The steam is sprayed normal to surface 42, as shown by arrows 1600 in FIG. 16. First crease portion 48 and second crease portion 52 are clamped together in the closed position of the creaser configuration as shown in FIG. 17, so that wrinkles are removed or reduced from a garment 1700 by steam, as shown by arrows 1702 in FIG. 17, and hot surfaces of first crease portion 48 and second crease portion 52 to function as a creaser.

Figure 18:
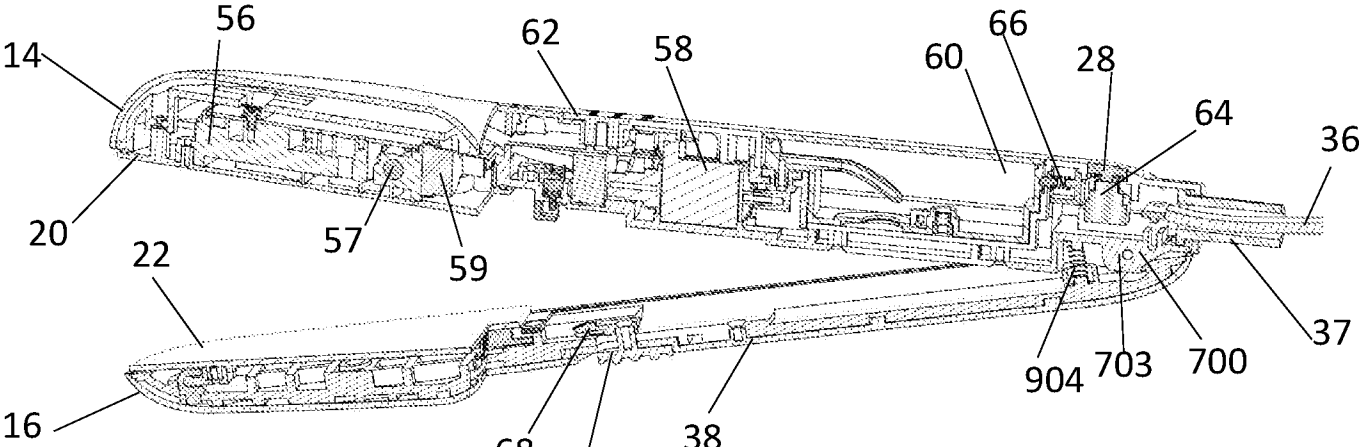
FIG. 18 is a partial side cross-sectional view of the garment care device of FIG. 1 in the creaser configuration and in the opened position.
Figure 19:
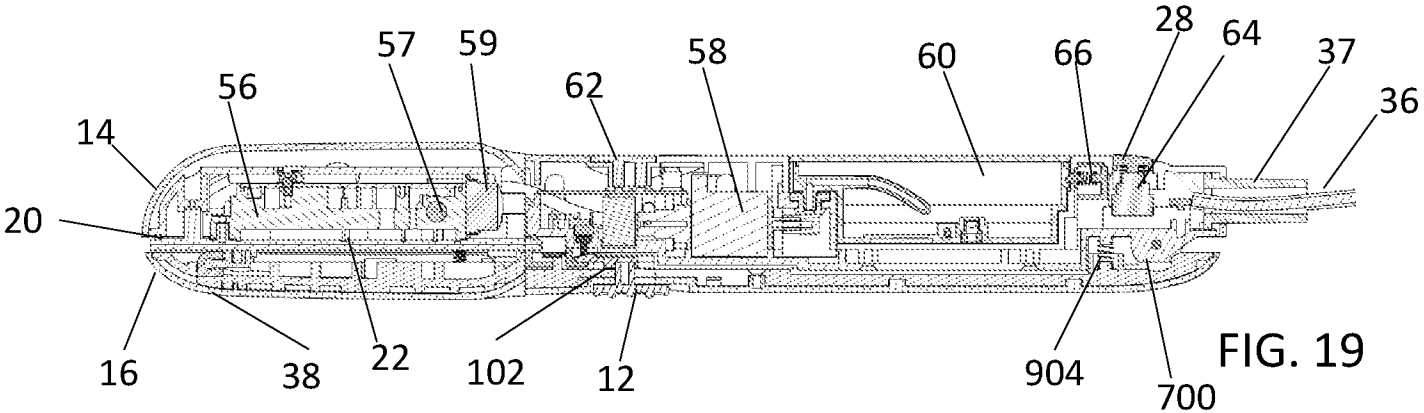
FIG. 19 is a partial side cross-sectional view of the garment care device of FIG. 1 in the steamer configuration.

Referring to FIGS. 18 and 19, first arm 14 is connected to second arm 16 by hinged connection 700. Spring 904 adjacent to hinged connection 700 keeps device 10 in the creaser configuration in the opened position, as shown in FIG. 18, when device is not locked in the closed position, as shown in FIG. 19. First arm 14 has first soleplate 20, a boiler assembly 56, a pump 58, a water tank assembly 60, control panel and printed circuit board ("PCB") assembly 62, power switch 64 connected to power button 28, spring bolt 66, power cord 36 connected to first arm housing 26. Boiler assembly 56 has a heating element 57 and a thermostat 59. Hinged connection 700 has second hinged member 902 that is a hinge pin 703. Second arm 16 has second soleplate 22, a locking mechanism 102 and locking button 12, connected to second arm housing 38. Control panel and printed circuit board ("PCB") assembly 62 can be a controller that has a microcontroller unit with a processor, memory, and information input/output (I/O).

Figure 20:
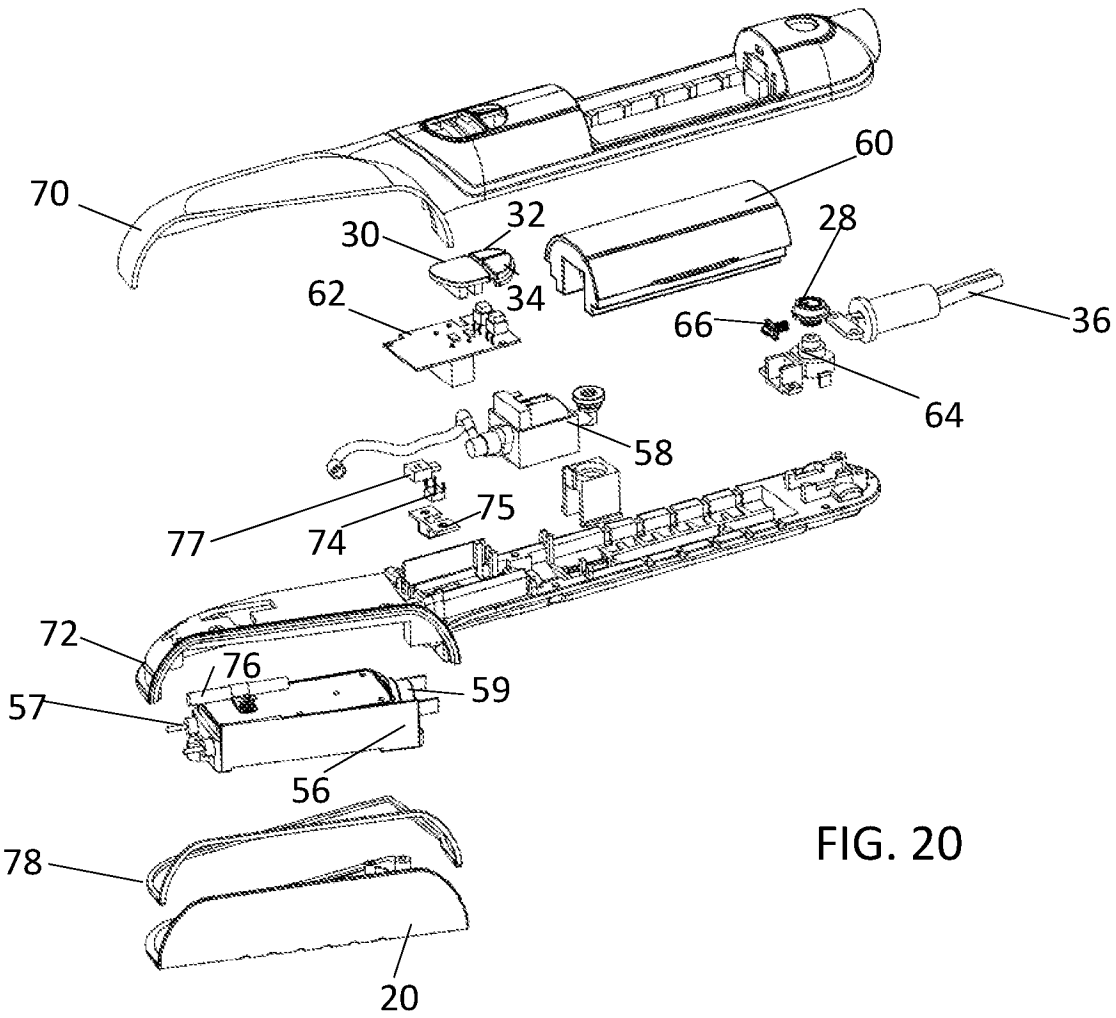
FIG. 20 is an exploded side perspective view of the first arm of the garment care device of FIG. 1.

Referring to FIG. 20, first arm 14 has an upper housing 70 and an upper bottom 72 that are connected to form first arm housing 26. First arm housing 26 houses a lock sensor 74, lock receptacle member 75, support 77, pump 58, control panel and PCB assembly 62, and power switch 64. In addition, power button 28, steamer/creaser indicator 30, indicator with button 32, steam button with indicator 34, water tank assembly 60, spring bolt 66, and power cord 36 each extend through first arm housing 26 when assembled. Boiler assembly 56 has heating element 57, thermostat 59 and a fuse 76 that are all between a seal ring 78, first soleplate 20 and upper bottom 72 of first arm housing 26. Upper bottom 72 also is connected to first hinged member 900 that receives hinge pin 703 of second hinged member 902.

Figure 21:
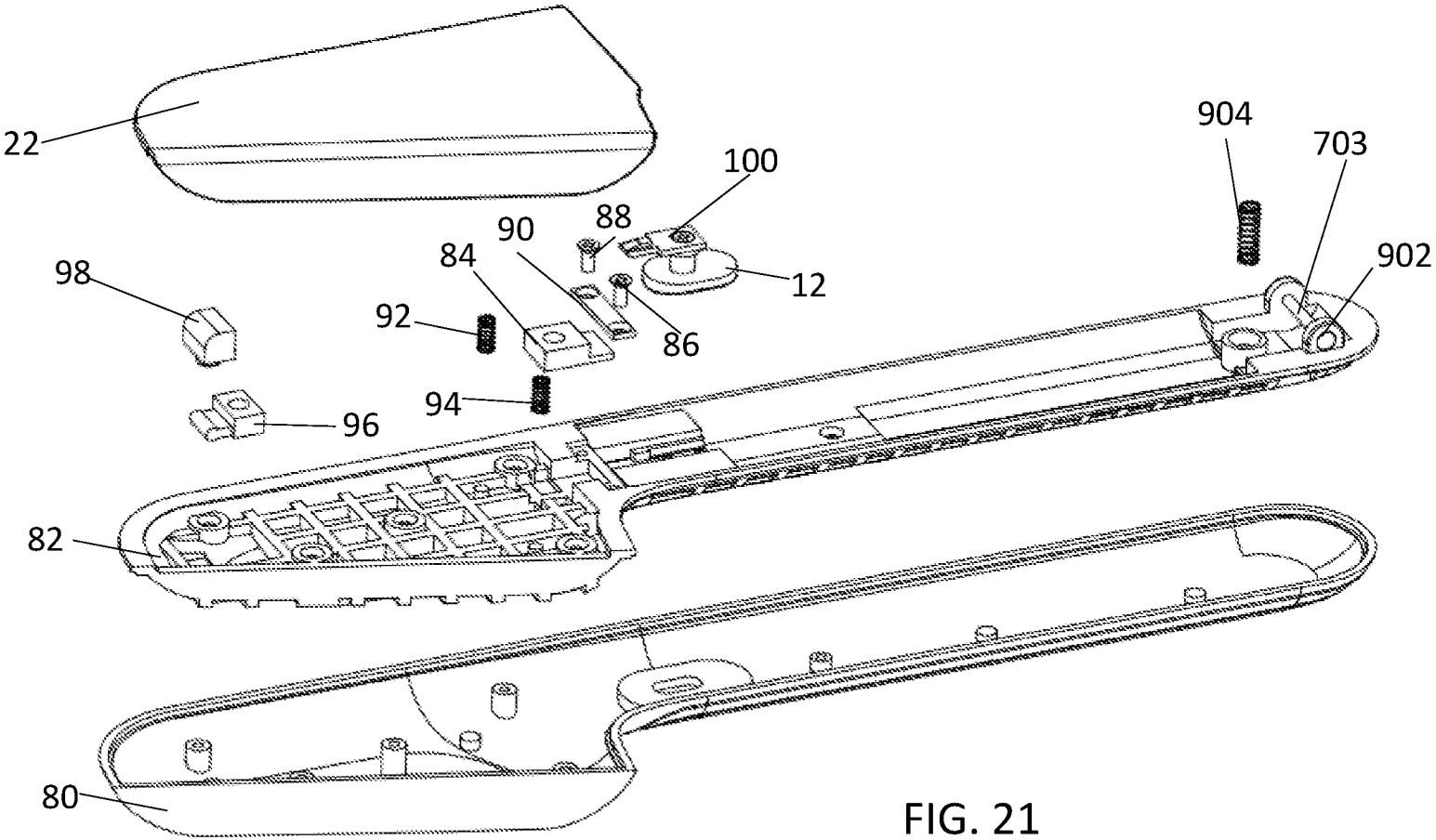
FIG. 21 is an exploded side perspective view of the second arm of the garment care device of FIG. 1.

Referring to FIG. 21, second arm 16 has a lower housing 80 and a lower cover 82 that are connected to form second arm housing 38. Lower cover 82 is connected to hinge pin 703 of second hinged member 902 and spring 904. Lower cover 82 is also connected to second soleplate 22, locking button 12, a stop block 84, a fastening assembly, for example, two screws 86, 88, a bar 90, compression springs 92, 94, a shaft cover 96 and a soleplate shaft 98. A locking bolt 100 is connected to locking button 12.

Figure 22:
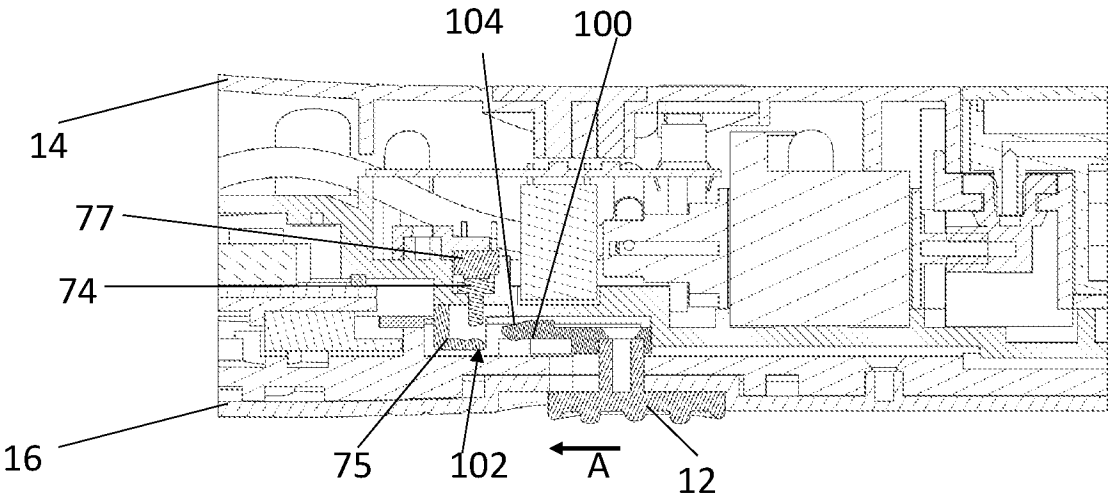
FIG. 22 is a partial side cross-sectional view of the garment care device of FIG. 1 having a locking button in an unlocked position.
Figure 23:
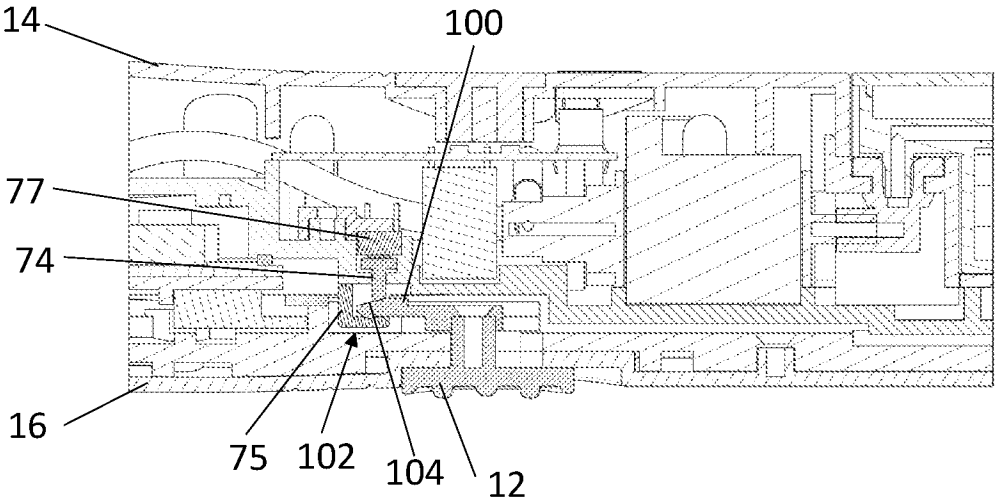
FIG. 23 is a partial side cross-sectional view of the garment care device of FIG. 1 having the locking button in a locked position.
Figure 46:
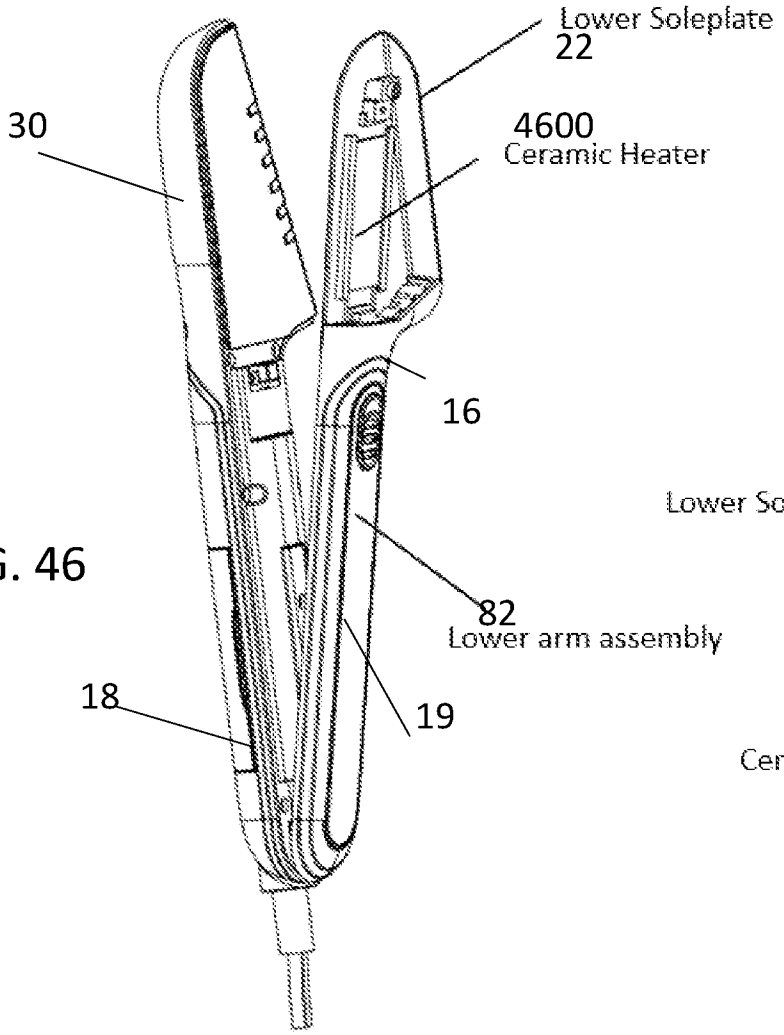
FIG. 46 is a side perspective view of the garment care device of FIG. 1 in the creaser configuration and in the opened position having parts removed for clarity modified to include a ceramic heater.

Referring to FIGS. 22 and 23, a locking mechanism 102 is formed by lock sensor 74, lock receptacle member 75, support 77, as shown in FIG. 20, and locking bolt 100 connected to locking button 12, as show in FIG. 21. When first arm 14 and second arm 16 are moved together to the steamer configuration, a force can be applied to push locking button 12 in second arm 16 forward in a direction shown by arrow A from an unlocked position, as shown in FIGS. 22 and 46, to insert locking bolt 100 into a hole of first arm 14 that can be formed of lock receptacle member 75 connected to first arm 14 to activate lock sensor 74 in a locked position as shown in FIGS. 6 and 23. A slope 104 of locking bolt 100 activates lock sensor 74. Lock sensor 74 can be a detection sensor that is, for example, a microswitch, a tact switch, infrared sensor, magnetic switch, or other detection sensor. Device 10 will preheat boiler assembly 56 and first soleplate 20 when device 10 is in the locked position as shown in FIG. 23 so that second soleplate 22 is heated by first soleplate 20 and boiler assembly 56. To unlock the device, a force can be applied to push locking button 12 in second arm 16 rearward in a direction opposite the direction shown by arrow A from the locked position, as shown in FIGS. 6 and 23, to remove locking bolt 100 from the hole of lock receptacle member 75 connected to first arm 14 to deactivate lock sensor 74 in the unlocked position, as shown in FIGS. 22 and 46.

Figure 25:
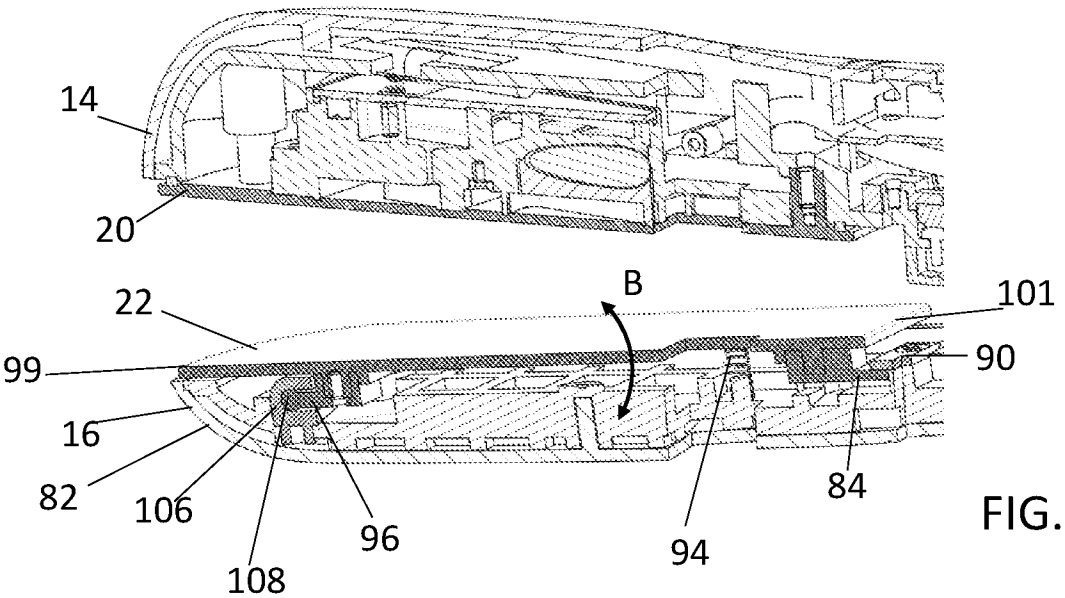
FIG. 25 is a partial side cross-sectional view of the garment care device of FIG. 1 in the creaser configuration and in the opened position.
Figure 24:
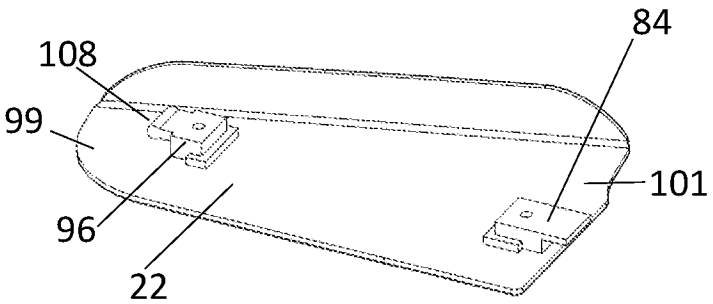
FIG. 24 is a side perspective view of the second soleplate of the garment care device of FIG. 1.
Figure 28:
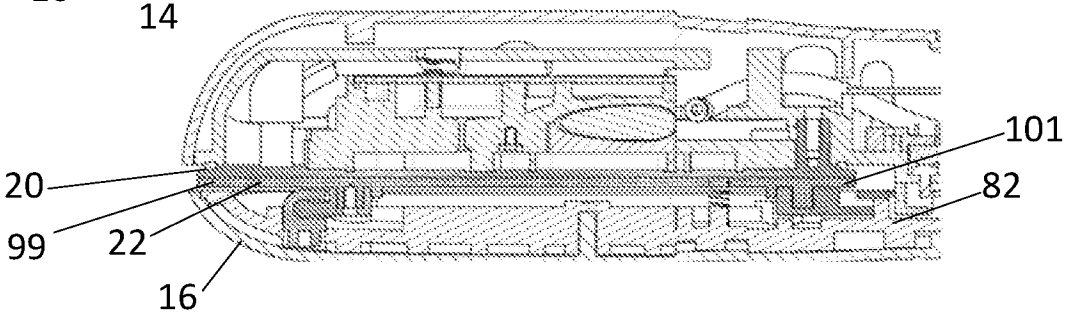
FIG. 28 is a partial side cross-sectional view of the garment care device of FIG. 1 in the creaser configuration in the closed position.
Figure 30:
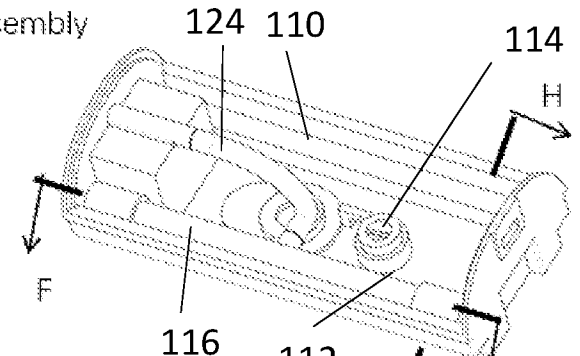
FIG. 30 is a side perspective view of the water tank assembly of FIG. 29 having parts removed for clarity.
Figure 29:
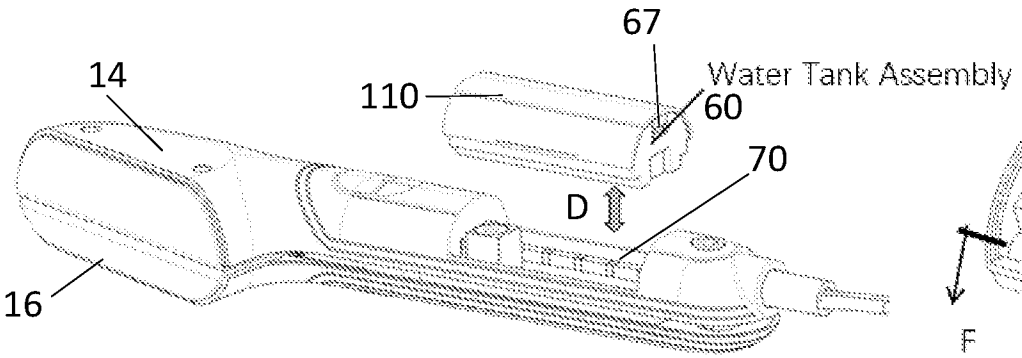
FIG. 29 is a side perspective view of the garment care device of FIG. 1 in the steamer configuration disconnected from a water tank assembly.
Figure 32:
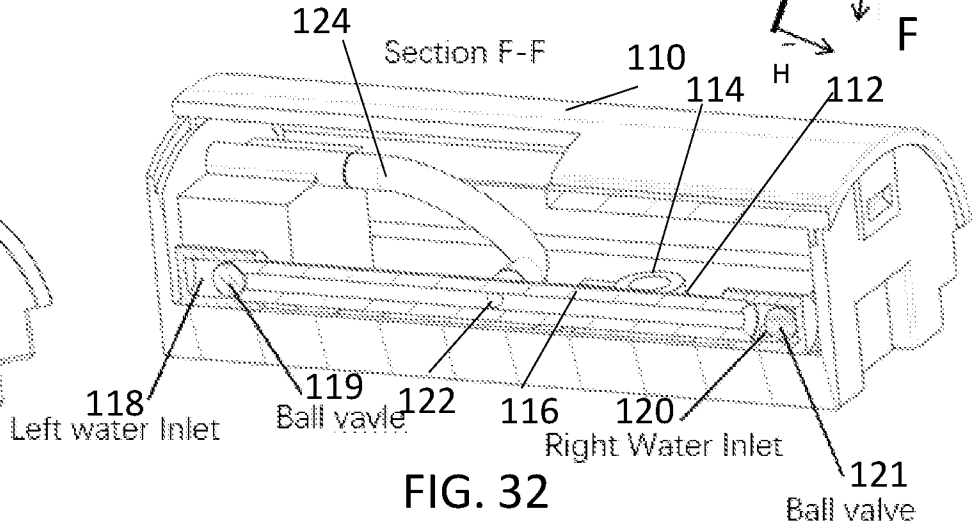
FIG. 32 is a side cross-sectional view of the water tank assembly of FIG. 29 with the cross-section taken along line F-F of FIG. 30 having parts removed for clarity.
Figure 31:
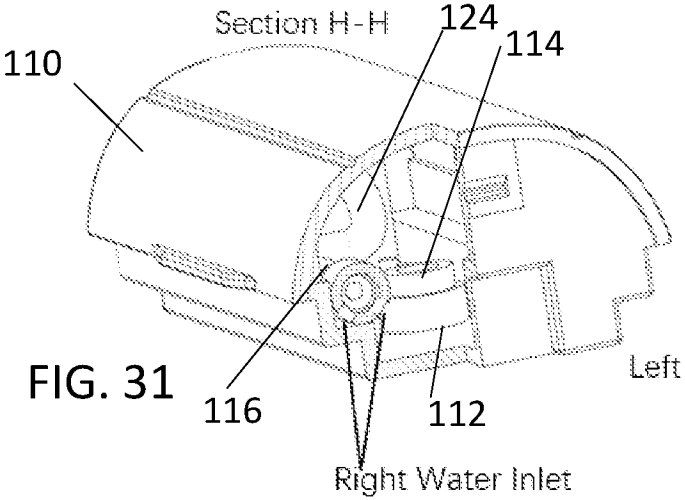
FIG. 31 is a rear perspective cross-sectional view of the water tank assembly of FIG. 29 with a partial cross-section taken along line H-H of FIG. 30.
Figure 33:
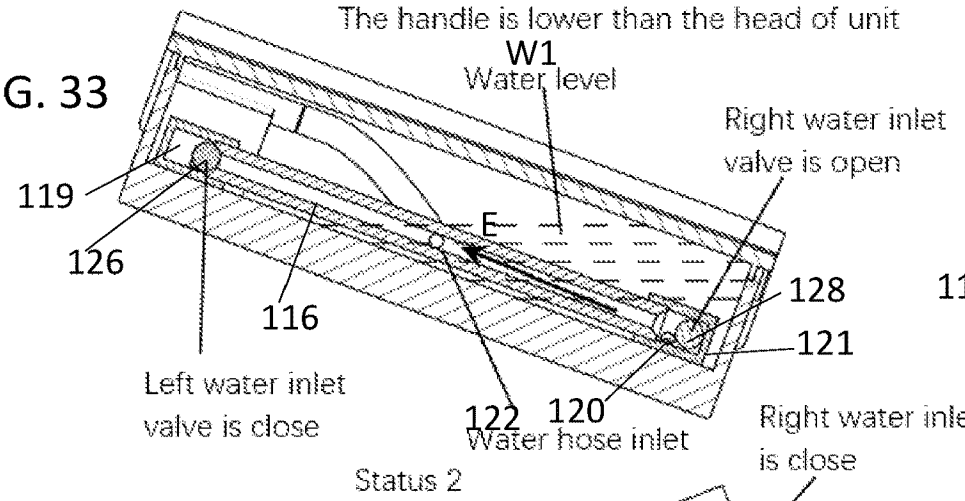
FIG. 33 is a side cross-sectional view of the water tank assembly of FIG. 29 having a first valve closed and a second valve opened.
Figure 34:
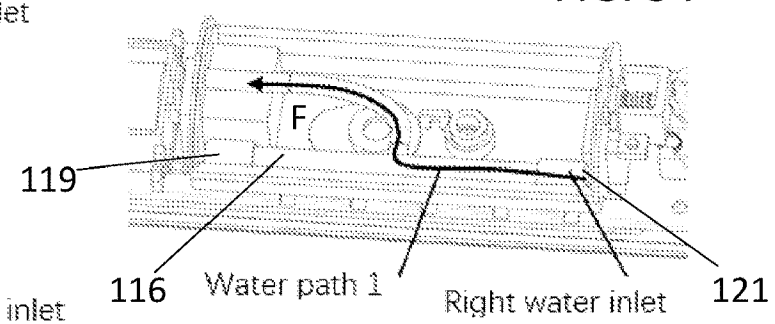
FIG. 34 is a side perspective view of the water tank assembly of FIG. 29 having parts removed for clarity and showing a water path from the second valve that is opened.
Figure 35:
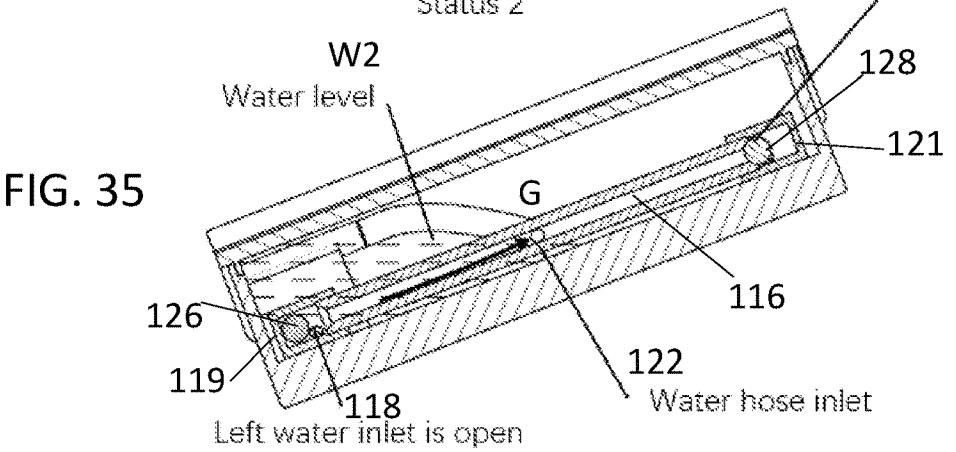
FIG. 35 is a side cross-sectional view of the water tank assembly of FIG. 29 having a first valve opened and a second valve closed.
Figure 36:
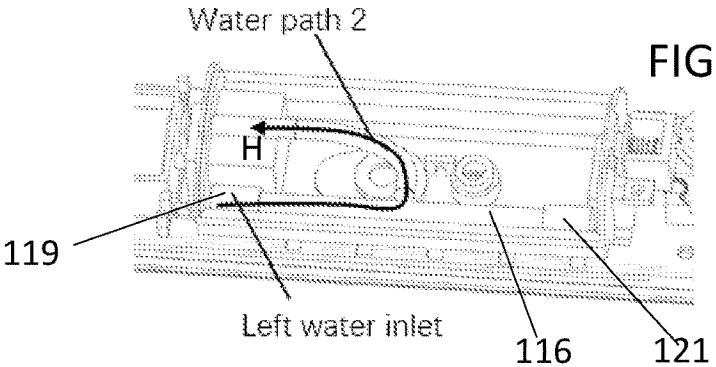
FIG. 36 is a side perspective view of the water tank assembly of FIG. 29 having parts removed for clarity and showing a water path from the first valve that is opened.

Referring to FIGS. 24 and 25, second arm 16 is connected to second soleplate 22 by a floating lower soleplate mechanism. Second soleplate 22 is rotatable relative to lower cover 82 of second arm 16 to make sure second soleplate 22 fits with first soleplate 20 or garments that device 10 is used with. The floating lower soleplate mechanism includes shaft cover 96 and a stop block 84 that are connected to second soleplate 22, a groove 106 formed in lower cover 82 of second arm 16, and compression springs 92, 94 that extend from lower cover 82 of second arm 16. Shaft cover 96 forms a rotation shaft 108 at a first end 99 of second soleplate 22. Stop block 84 is on a second end 101 of second soleplate 22 opposite first end 99. Rotation shaft 108 is rotatable in groove 106 to rotate second end 101 of second soleplate 22 toward and away from lower cover 82 of second arm 16 as shown by arrows B. Stop block 84 extends from second end 101 of second soleplate 22 so that a portion of stop block 84 is in between lower cover 82 and bar 90. Bar 90 limits the rotation of second end 101 of second soleplate 22 by stop block 84 abutting bar 90, as shown in FIG. 25, when device 10 is in the crease configuration and in the opened position. Lower cover 82 of second arm 16 limits the rotation of second end 101 of second soleplate 22 by stop block 84 abutting lower cover 82, as shown in FIG. 28, when device 10 is in the steamer configuration. Compression springs 92, 94 push second soleplate 22 away from lower cover 82 of second arm 16 when device 10 is in the crease configuration and in the opened position as shown in FIG. 25.

Figure 26:
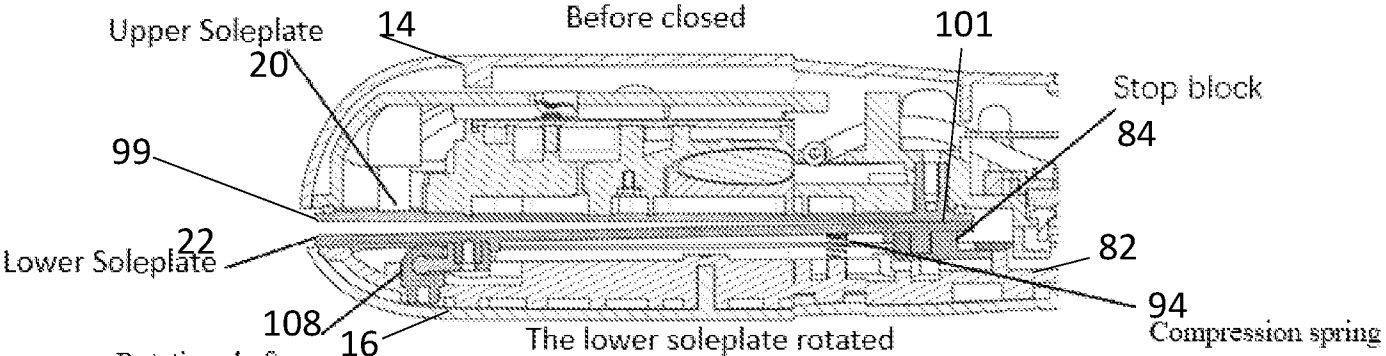
FIG. 26 is a partial side cross-sectional view of the garment care device of FIG. 1 in the creaser configuration before the garment care device is in the closed position with the first arm and the second arm at a first distance.

When device 10 moves from the crease configuration and in the opened position, as shown in FIG. 25, to the steamer configuration, as shown in FIG. 28, a back portion at second end 101 of second soleplate 22 contacts first soleplate 20 before first end 99 of second soleplate 22 contacts first soleplate 20, as shown in FIG. 26, as first soleplate 20 is moved toward second soleplate 22. As first arm 14 and second arm 16 continue to move to the steamer configuration from FIG. 26 to FIG. 27, second sole plate 22 is rotated as shown by arrow C toward lower cover 82 of second arm 16 so that first soleplate 20 continues to press against second soleplate 22 rotating second soleplate 22 until second soleplate 22 fits with first soleplate 20 tightly as shown in FIG. 28.

Figure 27:
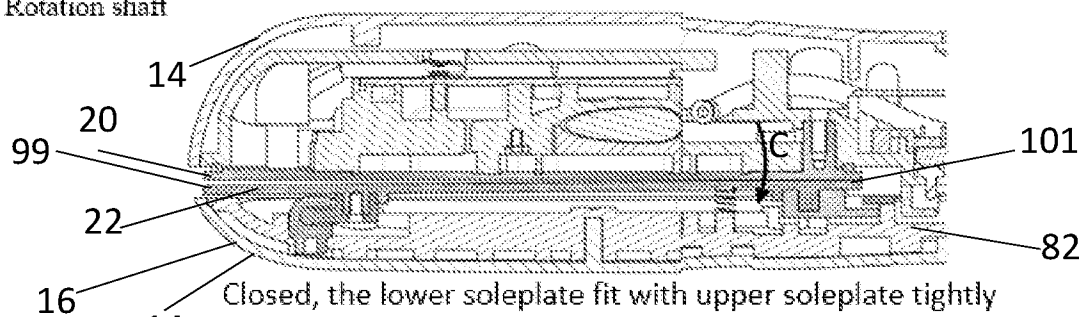
FIG. 27 is a partial side cross-sectional view of the garment care device of FIG. 1 in the creaser configuration before the garment care device is in the closed position with the first arm and the second arm at a second distance.

When device 10 moves from the steamer configuration, as shown in FIG. 28, to the crease configuration and in the opened position, as shown in FIG. 25, back portion at second end 101 of second soleplate 22 maintains contact with first soleplate 20 and first end 99 of second soleplate 22 no longer contacts first soleplate 20, as shown in FIG. 27, as first soleplate 20 is moved away from second soleplate 22. As first arm 14 and second arm 16 continue to move to the crease configuration and in the opened position from FIG. 27 to FIG. 26, second sole plate 22 is rotated in a direction that is opposite a direction as shown by arrow C away from lower cover 82 of second arm 16 so that first soleplate 20 continues to move away from second soleplate 22 rotating second soleplate 22 until stop block 84 abuts bar 90, as shown in FIG. 25, when device 10 is in the crease configuration and in the opened position.

Referring to FIGS. 29-32, water tank assembly 60 can be removable or not removable from upper housing 70 of first arm 14. FIGS. 29-32, show water tank assembly 60 that is removable from upper housing 70 of first arm 14 as shown by arrows D in FIG. 29. When water tank assembly 60 is in place in upper housing 70 spring bolt 66 fits in a depression 67 in a water tank housing 110 to urge water tank assembly 60 into upper housing 70 to maintain water tank assembly 60 in upper housing 70 by snap fit. Water tank assembly 60 has water tank housing 110 that is fillable with water, for example, through a hole 112 that has a cap 114 to open and close hole 112. A tube 116 is inside water tank housing 110. Tube 116 has a first water inlet 118 inside a first ball valve assembly 119 and a second water inlet 120 inside a second ball valve assembly 121. First ball valve assembly 119 and second ball valve assembly 121 are connected to opposite ends of tube 116. Tube 116 has a water hose inlet 122 where tube 116 is connected to a water hose 124 so that water can flow from tube 116 to water hose 124.

Referring to FIGS. 33-36, tube 116 having first ball valve assembly 119 and second ball valve assembly 121 forms a dual water inlet valve to make sure the water can be pumped from water tank assembly 60 through pump 58 to boiler assembly 56. First ball valve assembly 119 and second ball valve assembly 121 open or close a water inlet, namely, first ball valve assembly 119 opens and closes first water inlet 118 and second ball valve assembly 121 opens and closes second water inlet 120. First ball valve assembly 119 has a first ball 126 that rolls by gravity to open or close first water inlet 118. Second ball valve assembly 121 has a second ball 128 that rolls by gravity to open or close second water inlet 120. When handles 18, 19 of device 10 are lower than a head 130 of device where first soleplate 20 and second soleplate 22 are positioned, as shown in FIG. 46, water flows toward second ball valve assembly 121 as shown by water level W1 and second ball 128 rolls by gravity to uncover second water inlet 120 so that second ball valve assembly 121 is open and first ball 126 rolls by gravity to cover first water inlet 118 so that first ball valve assembly 119 is closed allowing water to flow through second water inlet 120 through water hose inlet 122 as shown by arrow E in FIG. 33, and the water can then flow through water hose 124 as shown by arrow F in FIG. 34 out of water tank assembly 60 while closing first ball valve assembly 119 so that water cannot flow through first water inlet 118. When handles 18, 19 of device 10 are higher than head 130 of device where first soleplate 20 and second soleplate 22 are positioned, as shown in FIG. 2, water flows toward first ball valve assembly 119 as shown by water level W2 and first ball 126 rolls by gravity to uncover first water inlet 118 so that first ball valve assembly 119 is open and second ball 128 rolls by gravity to cover second water inlet 120 so that second ball valve assembly 121 is closed allowing water to flow through first water inlet 118 through water hose inlet 122 as shown by arrow G in FIG. 35, and the water can then flow through water hose 124 as shown by arrow H in FIG. 36 out of water tank assembly 60 while closing second ball valve assembly 121 so that water cannot flow through second water inlet 120.

Figure 37:
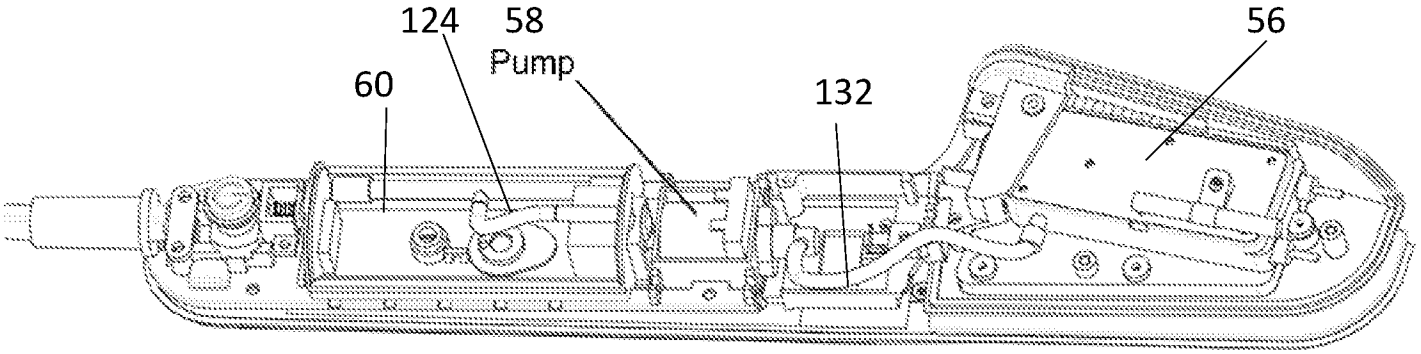
FIG. 37 is a side perspective view of the first arm of FIG. 9 having parts removed for clarity.
Figure 38:
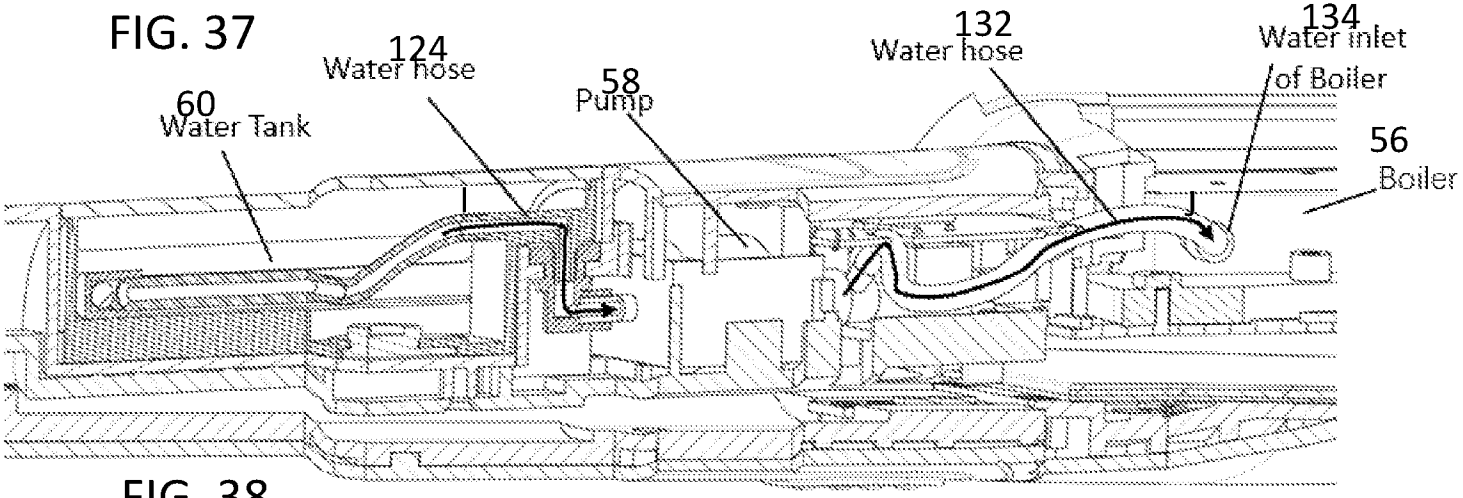
FIG. 38 is a partial side perspective cross-sectional view of the first arm of FIG. 9 having arrows to show a water path.

Referring to FIGS. 37 and 38, water tank assembly 60 is connected to pump 58 so that water can flow from water tank assembly 60 to pump 58 through water hose 124 as shown by arrow I in FIG. 38. Pump 58 is connected to boiler assembly 56 so that water can flow from pump 58 to boiler assembly 56 through a water hose 132 through a boiler inlet 134 as shown by arrow J in FIG. 38.

Figure 40:
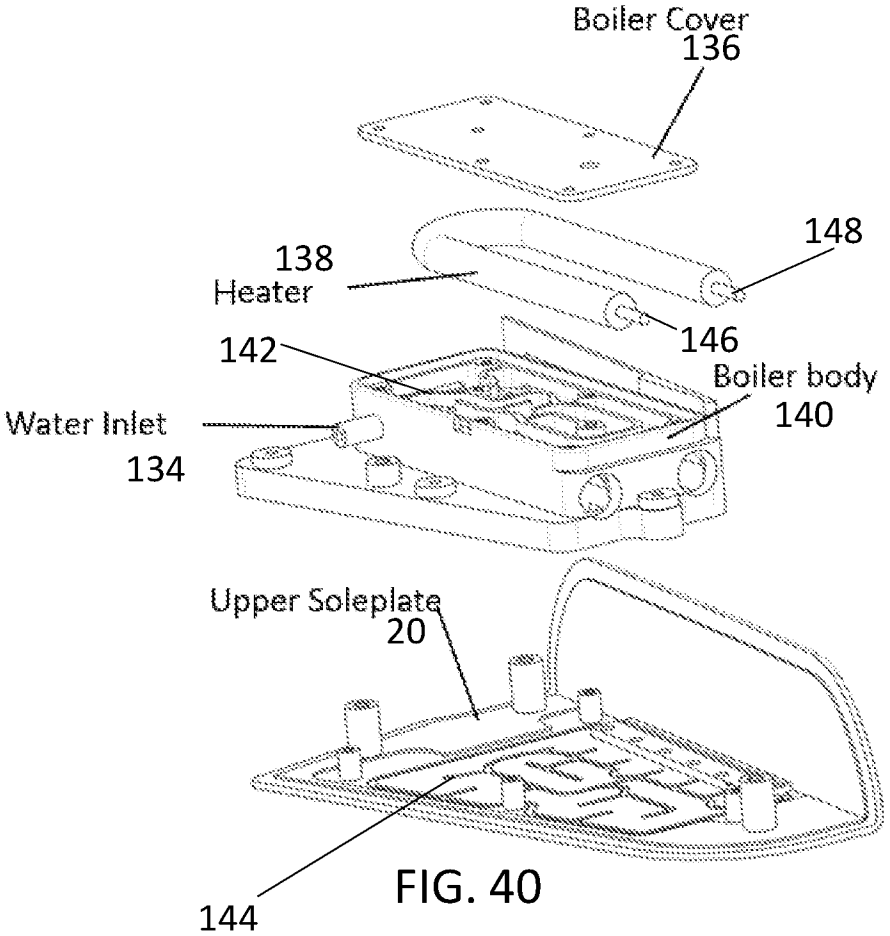
FIG. 40 is an exploded side perspective view of FIG. 39.
Figure 39:
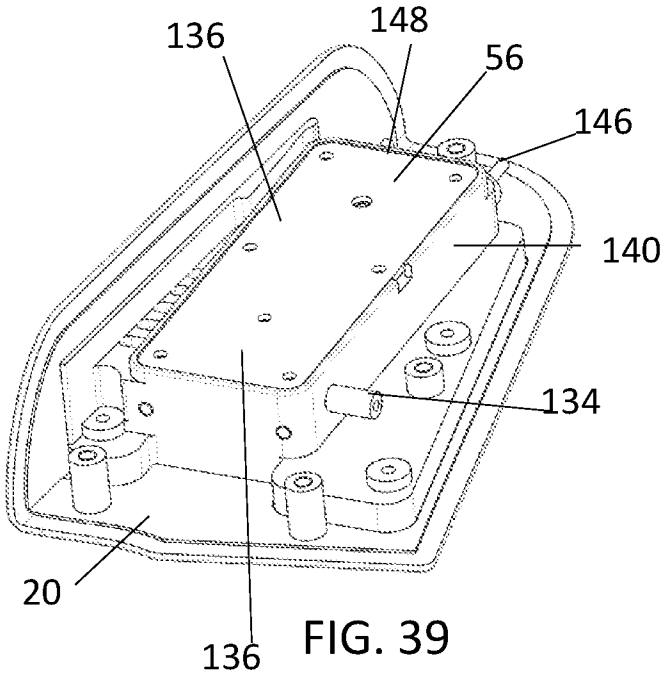
FIG. 39 is a side perspective view of the first soleplate of the garment care device of FIG. 1 connected to a boiler assembly.

Referring to FIGS. 39 and 40, boiler assembly 56 is connected to first soleplate 20 so that boiler assembly 56 can conduct heat to first soleplate 20 during operation of device 10. Boiler assembly 56 has a boiler cover 136, a heater 138, a boiler body 140. Heater 138 is positioned in boiler body 140 and boiler cover 136 is connected over heater 138 on boiler body 140 on a first side. Boiler body 140 is connected to first soleplate 20 on a second side that is opposite the first side. Boiler body 140 has walls 142 that form water/steam flow paths for water/steam to flow through on opposite sides of boiler body 142. Boiler body 140 has boiler inlet 134 for the water to enter the water/steam flow paths of boiler body 140. First soleplate 20 has ridges 144 that follow a pattern formed by walls 142 of boiler body 140. Heater 138 has ends 146, 148 that connect to a power source, for example, connect directly or indirectly to power cord 36.

Figures 41, 42, 43, 44, 45:
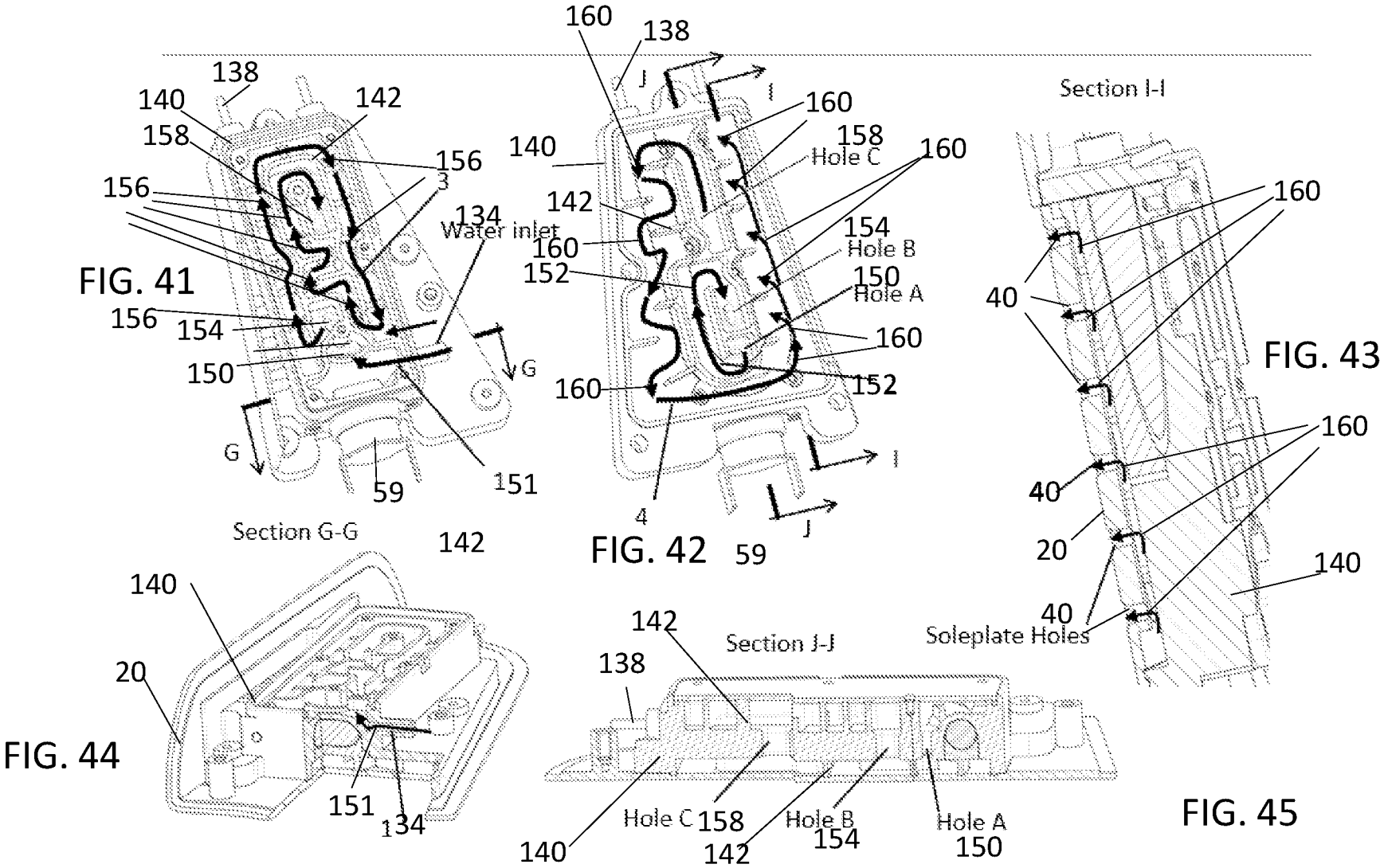
FIG. 41 is a side perspective cross-sectional view of FIG. 39 having arrows showing a water/steam path and the cross-section taken on a first side of the boiler assembly of FIG. 39.
FIG. 42 is a side perspective cross-sectional view of FIG. 39 having arrows showing the water/steam path and the cross-section taken on a second side that is opposite to the first side of FIG. 41 of the boiler assembly of FIG. 39.
FIG. 43 is a side cross-sectional view of FIG. 42 having the cross-section taken along line I-I of FIG. 42.
FIG. 44 is a front perspective cross-sectional view of FIG. 41 having a portion removed along line G-G of FIG. 41.
FIG. 45 is a side perspective cross-sectional view of FIG. 42 having the cross-section taken along line J-J of FIG. 42.

Referring to FIGS. 41-45, water flows from pump 58 to boiler assembly 56 through water hose 132 into boiler inlet 134 so that the water can be heated to form water/steam in boiler assembly 56. From boiler inlet 134, the water/steam flows through a hole 150 as shown by arrow 151 in FIGS. 41 and 44 to a water/steam flow path as shown by arrows 152 in FIG. 42 to a hole 154 so that the water/steam flows through hole 154 to a water/steam path as shown by arrows 156 in FIG. 41 to hole 158 so that the water/steam flows through hole 158 to a water/steam path as shown by arrows 160 in FIG. 42 so that the water/steam flows out of steam holes 40 as shown in FIG. 43. Referring to FIG. 45, holes 150, 154 and 158 are each through boiler body 40.

Figure 47:
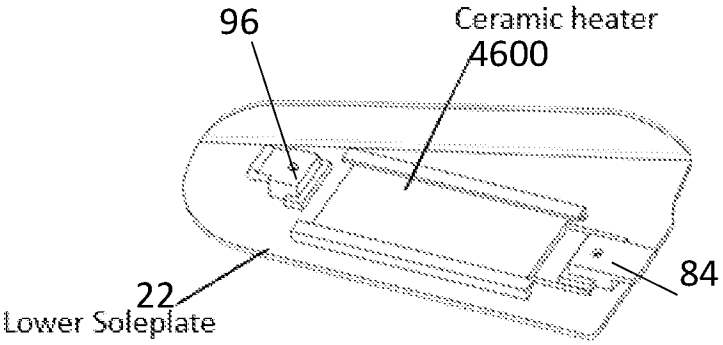
FIG. 47 is a side perspective view of the second soleplate of the garment care device of FIG. 46 connected to the ceramic heater assembly.
Figure 48:
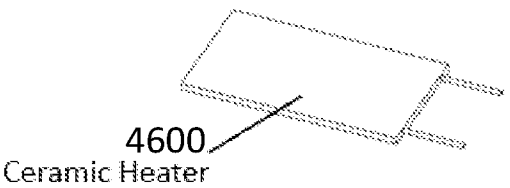
FIG. 48 is a side perspective view of the ceramic heater assembly of FIG. 47.

Referring to FIGS. 46-48, second arm 16 can be modified to have a ceramic heater 4600 connected between lower cover 82 and second soleplate 22 to heat second soleplate 22. Ceramic heater 4600 can be connected to second soleplate 22 between shaft cover 96 and stop block 84.

Figures 49, 50, 51:
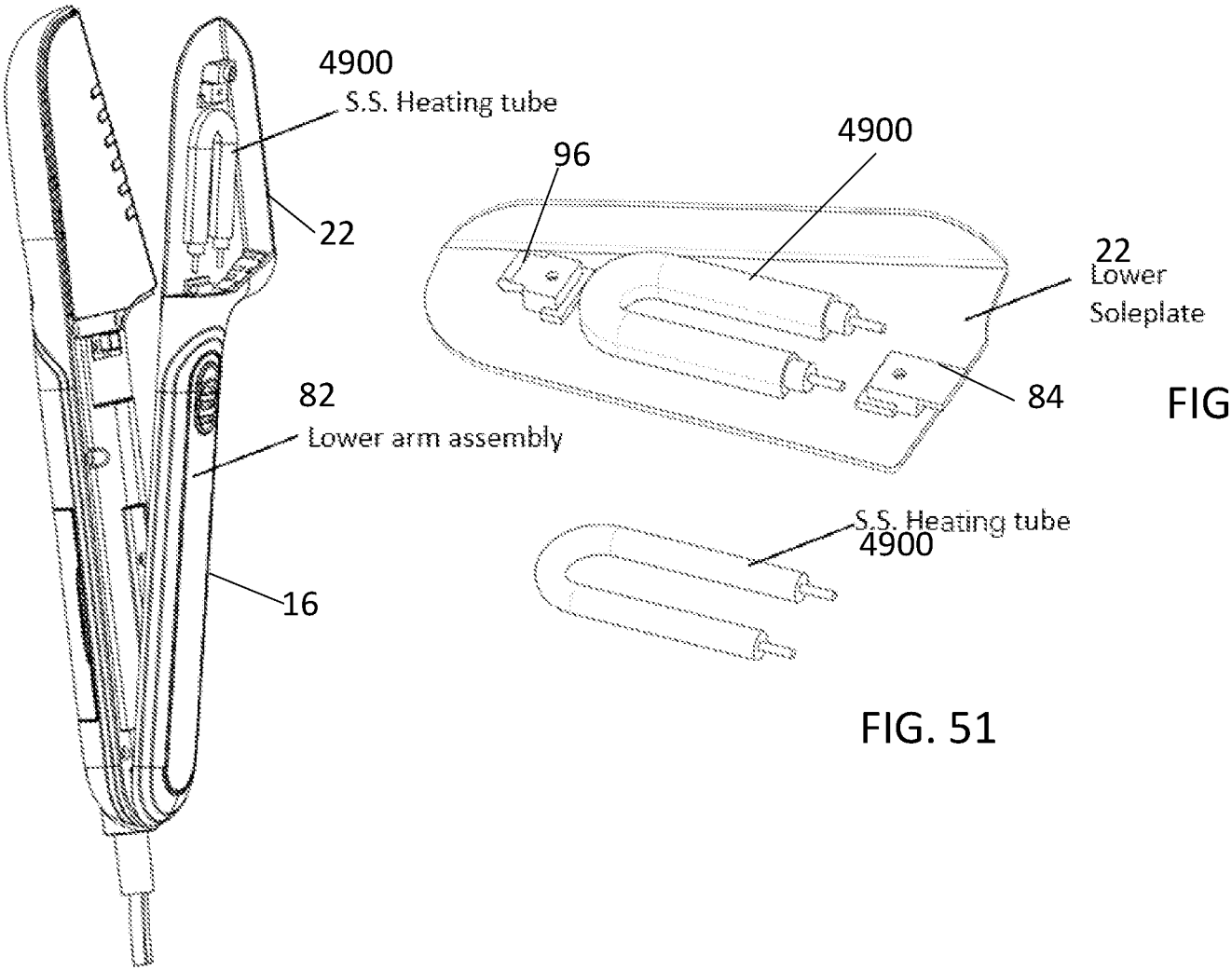
FIG. 49 is a side perspective view of the garment care device of FIG. 1 in the creaser configuration and in the opened position having parts removed for clarity modified to include a heating tube assembly.
FIG. 50 is a side perspective view of the second soleplate of the garment care device of FIG. 49 connected to the heating tube assembly.
FIG. 51 is a side perspective view of the heating tube assembly of FIG. 50.

Referring to FIGS. 49-51, second arm 16 can be modified to have a heating tube 4900 connected between lower cover 82 and second soleplate 22 to heat second soleplate 22. Heating tube 4600 can be a stainless steel heating tube. Heating tube 4900 can be connected to second soleplate 22 between shaft cover 96 and stop block 84.

Referring back to FIG. 18, a user can turn on device 10 by pressing power button 28 that contacts power switch 64 so that electric current is conducted to one or more of pump 58, control panel and PCB assembly 62, and heater 57. Control panel and PCB assembly 62 can control device 10 to preheat first soleplate 14 by activating heater 57 when device 10 is turned on only when device 10 is in the locked position in the steamer configuration. If device 10 is not in the locked position in the steamer configuration, the user can apply the force to push locking button 12 in second arm 16 forward in the direction shown by arrow A from an unlocked position, as shown in FIGS. 22 and 46, to insert locking bolt 100 into the hole of first arm 14 that can be formed of lock receptacle member 75 connected to first arm 14 to activate lock sensor 74 in a locked position as shown in FIGS. 6 and 23. A slope 104 of locking bolt 100 activates lock sensor 74.

Figure 52:
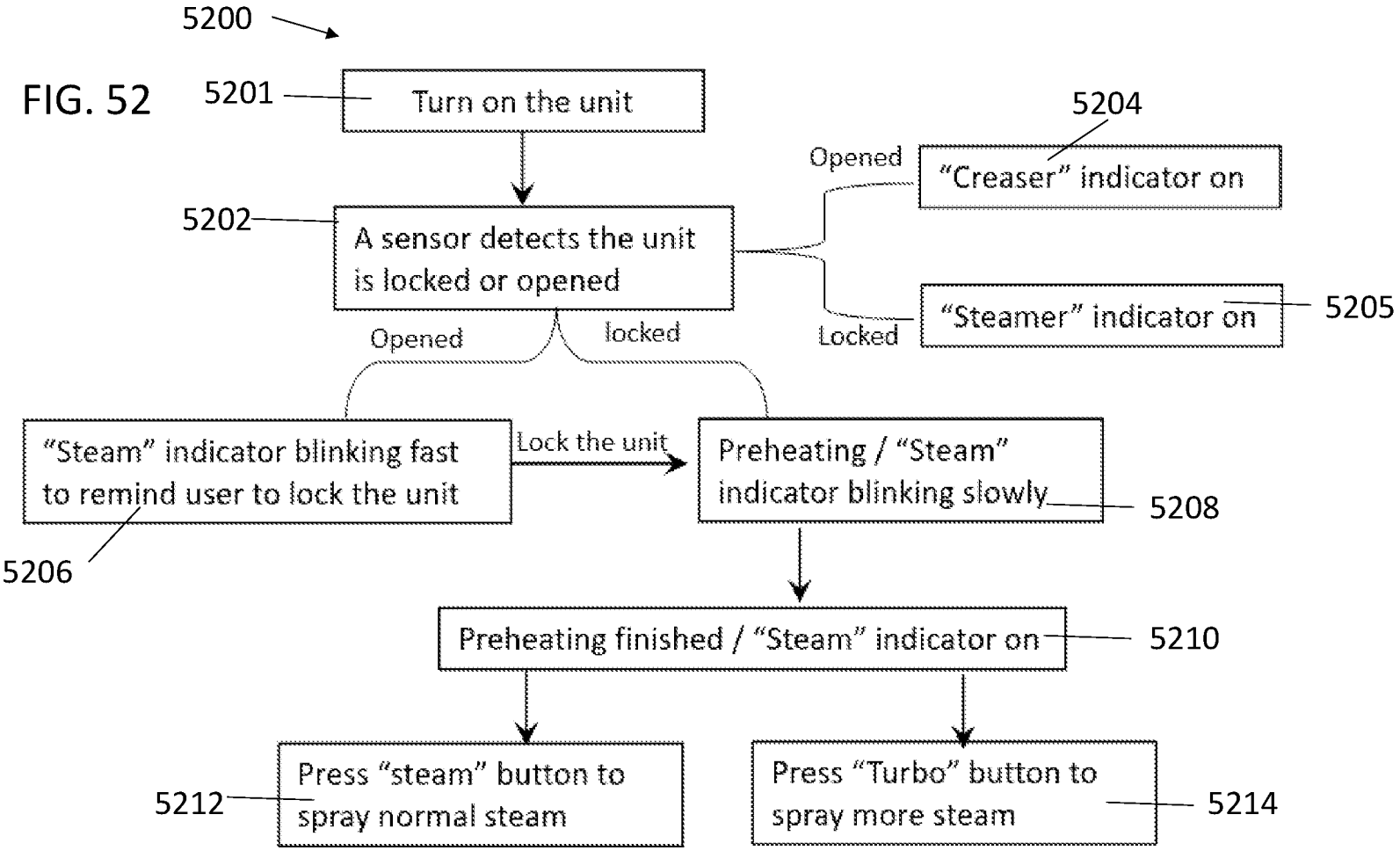
FIG. 52 is a schematic diagram of an exemplary method of operating the garment care device of FIG. 1.

Referring to FIG. 52, a method 5200 can be used with device 10. A user can turn on device 10 by pressing power button 28 in step S201 and proceeds to step S202 where lock sensor 74 detects if device 10 is in the locked position or the unlocked position. If device 10 is in the unlocked position of the creaser configuration, then steamer/creaser indicator 30, as shown in FIG. 5, displays an indicator that device 10 is in the unlocked position of the creaser configuration, for example, by displaying a "Creaser" indicator in step S204. If device 10 is in the locked position of the steamer configuration, steamer/creaser indicator 30 displays an indicator that device 10 is in the locked position of the steamer configuration, for example, by displaying a "Steamer" indicator, in step S205. If device 10 is in the unlocked position of the creaser configuration, steamer/creaser indicator 30 also indicates, for example, by displaying a fast blinking light, to the user to move device 10 to the locked position of the steamer configuration in step S206 and proceeds to step S208. If device 10 is in the locked position of the steamer configuration, then method 5200 moves from step S202 to step S208. In step S208, steamer/creaser indicator 30 indicates, for example, by displaying a slow blinking light, that device 10 is preheating and/or generating steam and proceeds to step S210. Second soleplate 22 is heated by first soleplate 20 during preheating in step S208 so that second soleplate 22 is beneficial to remove wrinkles of fabric with no condensate water on it. In step S210, steamer/creaser indicator 30 indicates, for example, by displaying "Steam", that preheating of device 10 is finished and proceeds to either step S212 or step S214. In step S212, the user can press button with indicator 34, as show in FIG. 5, to spray normal steam. In step S214, the user can press indicator with button 32, as show in FIG. 5, to spray more steam than normal steam.

When first soleplate 14 is heated, first soleplate 14 can conduct heat to second soleplate 16 when device 10 is in the locked position of the steamer configuration. Once device 10 is preheated, then the user can use device 10 in the steamer configuration to remove or reduce wrinkles in fabric as shown by FIG. 2 or use device 10 in the unlocked position in the creaser configuration, as shown in FIGS. 3 and 4.

If the user would like to generate steam while using device 10 in the locked position of the steamer configuration, the user presses indicator with button 32 or button with indicator 34 that each can activate pump 58 to draw water from water tank assembly 60, as shown in FIG. 37, so that the water flows through water hose 124, pump 58, water hose 132 and through water inlet 134 of boiler assembly 56. Referring back to FIGS. 41-45, the water can be heated to form water/steam in boiler assembly 54. From boiler inlet 134, the water/steam flows through hole 150 as shown by arrow 151 in FIGS. 41 and 44 to the water/steam flow path as shown by arrows 152 in FIG. 42 to hole 154 so that the water/steam flows through hole 154 to the water/steam path as shown by arrows 156 in FIG. 41 to hole 158 so that the water/steam flows through hole 158 to the water/steam path as shown by arrows 160 in FIG. 42 so that the water/steam flows out of steam holes 40 as shown in FIG. 43. As shown in FIG. 15, the steam is sprayed out from one of steam holes 40 through one of the steam channels, as shown by arrow 1500 in FIG. 15, formed by second crease portion 52 covering grooves 44 and the steam is sprayed normal to first steamer portion 50 and second steamer portion 54, as shown by arrows 1400 in FIG. 14, onto fabric 1402. To stop the generation of steam, the user can press indicator with button 32 or button with indicator 34 again or if the user was continuously pressing indicator with button 32 or button with indicator 34, then the user can stop pressing indicator with button 32 or button with indicator 34, that deactivates pump 58.

If the user would like to generate steam while using device 10 in the unlocked position of the creaser configuration, the user applies the force to push locking button 12 in second arm 16 rearward in the direction opposite the direction shown by arrow A in FIG. 22 from the locked position, as shown in FIGS. 6 and 23, to remove locking bolt 100 from the hole of lock receptacle member 75 connected to first arm 14 to deactivate lock sensor 74 in the unlocked position, as shown in FIGS. 22 and 46. The user presses indicator with button 32 or button with indicator 34 that can each activate pump 58 to draw water from water tank assembly 60, as shown in FIG. 37, so that the water flows through water hose 124, pump 58, water hose 132 and through water inlet 134 of boiler assembly 56. Referring back to FIGS. 41-45, the water can be heated to form water/steam in boiler assembly 54. From boiler inlet 134, the water/steam flows through hole 150 as shown by arrow 151 in FIGS. 41 and 44 to the water/steam flow path as shown by arrows 152 in FIG. 42 to hole 154 so that the water/steam flows through hole 154 to the water/steam path as shown by arrows 156 in FIG. 41 to hole 158 so that the water/steam flows through hole 158 to the water/steam path as shown by arrows 160 in FIG. 42 so that the water/steam flows out of steam holes 40 as shown in FIG. 43. The steam is sprayed normal to surface 42, as shown by arrows 1600 in FIG. 16. First crease portion 48 and second crease portion 52 are clamped together in the closed position of the creaser configuration as shown in FIG. 17, so that wrinkles are removed or reduced from a garment 1700 by steam, as shown by arrows 1702 in FIG. 17, and hot surfaces of first crease portion 48 and second crease portion 52 to function as a creaser. To stop the generation of steam, the user can press indicator with button 32 or button with indicator 34 again or if the user was continuously pressing indicator with button 32 or button with indicator 34, then the user can stop pressing indicator with button 32 or button with indicator 34, that deactivates pump 58.

After device 10 is preheated, device 10 can be freely moved between the locked position of the steamer configuration and the unlocked position of the creaser configuration by moving locking button 12 as discussed herein. A user can turn off device 10 by pressing power button 28 that contacts power switch 64 so that electric current is no longer conducted to one or more of pump 58, control panel and PCB assembly 62, and heater 57.

Advantageously, device 10 is a handheld garment care device which can apply the same steam generating system design to perform garment ironing and a creaser function. A further advantage of device 10 is that each of first soleplate 20 and second soleplate 22 have a first ironing surface and a second ironing surface that are orthogonally opposed, and independently used, namely, first crease portion 48 and first steamer portion 50 that form the L shape of first soleplate 20 and second crease portion 52 and second steamer portion 54 of second soleplate 22. Device 10 has two-dimensional ironing surfaces which are in "L" shape, namely, of first soleplate 20 and second soleplate 22, but is not limited to two surfaces having an angle of 90 degrees, but also could be in a range of 60 to 150 degree for fitting different steam ironing purposes. The two-dimensional ironing surfaces of first soleplate 20 and second soleplate 22 which are in the "L" shape can have steam ironing surfaces that are curved for facilitate steam ironing. The two-dimensional ironing surfaces of first soleplate 20 and second soleplate 22 can perform different functions, one surface is for a steam creaser and another surface is for steam ironing. The steam output direction of device 10 can be switched by the creaser configuration and the steamer configuration of the ironing surface, as at least one of ironing surface of first soleplate 20 and second soleplate 22 comprises steam holes and/or grooves. When first soleplate 20 and second soleplate 22 are attached with one another in an ironing surface (that is not limited to the L shape of first soleplate 20 and second soleplate 22), the steam holes and grooves create a steam channel to redirect the steam 90 degrees. Water tank assembly 60 can be removable or not removable. A dual water inlet valve design of tube 116 having first ball valve assembly 119 and second ball valve assembly 121 makes sure all the water can be pumped into boiler assembly 56 in different orientation of use of device 10. A control logic, for example, of control panel and PCB assembly 62, that associates with a locking mechanism to ensure second soleplate 22 that can be without a heater can attach to first soleplate 20 that is heated can preheat together during cold start, which can avoid steam condensation at second soleplate 22 without the heater during a first preheat of device 10. This control logic, for example, of control panel and PCB assembly 62, has a locking mechanism that incorporates with a sensor to detect whether the lock is secured, then gives a feedback signal for panel indication or heater preheat feedback. Alternatively, second soleplate 22 can be with or without a heater to heat it. The heater of second soleplate 22 can be positive temperature coefficient ("PTC") heater, film heater, S.S. heater tube, or other heater. Alternative on device 10 can be a pump with dual boiler system, thus each of first soleplate 20 and second soleplate 22 can have one of two boiler assemblies 56, and second soleplate 22 can have steam holes, and water can be pumped from water tank assembly 60 through pump 58 and deliver to two of boiler assemblies 56 at the same time, thus both first soleplate 20 and second soleplate 22 could emit steam.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents can be substituted for elements thereof without departing from the scope of the present disclosure. In addition, many modifications can be made to adapt a particular situation or material to the teachings of the disclosure without departing from the scope thereof. Therefore, it is intended that the present disclosure should not be limited to the particular embodiment(s) disclosed as the best mode contemplated, but that the disclosure will include all embodiments falling within the scope of the appended claims.

What is claimed is:

1. A handheld garment care device comprising:

a first ironing surface and a second ironing surface that are permanently fixed orthogonal to each other in orientation, the first ironing surface and the second ironing surface are each heated ironing surfaces, wherein the first ironing surface and the second ironing surface are connected to a first handle, and further comprising a third ironing surface and a fourth ironing surface that are orthogonally opposed and independently used that are connected to a second handle, and wherein the first handle and the second handle are maintained in a fixed position in a steamer configuration and the first handle and the second handle are movable toward and away from one another in a creaser configuration.

2. The handheld garment care device of claim 1, wherein the first ironing surface has a plurality of steam holes and a plurality of grooves so that each of the plurality of grooves extends from one of the plurality of steam holes.

3. The handheld garment care device of claim 2, wherein, when the first and second handles are closed together in the steamer configuration, steam can still be emitted away from the first ironing surface and the second ironing surface because each of the plurality of grooves directs steam from one of the plurality of steam holes to direct the steam out even when the first and second handles are maintained in the fixed position in the steamer configuration.

4. The handheld garment care device of claim 3, wherein the same steam hole of the plurality of steam holes facilitates steam emission in either of the steamer configuration or the creaser configuration.

5. The handheld garment care device of claim 2, wherein the third surface contacts the first surface in the steamer configuration so that the third surface covers each of the plurality of steam holes through the first surface.

6. The handheld garment care device of claim 3, wherein the second surface is adjacent the fourth surface so that at least a portion of each of the second surface and the fourth surface face the same direction to be able to contact a garment for ironing or steaming.

7. The handheld garment care device of claim 1, wherein the first handle and the second handle can be positioned on opposite sides of a garment and the first handle can be moved toward the second handle so that each of the first surface and the third surface contact the garment on opposite sides of the garment in the creaser configuration.

8. The handheld garment care device of claim 7, further comprising a lock sensor so that the creaser configuration and the steamer configuration can be detected.

9. A handheld garment care device comprising:

a first handle and a second handle that are pivotally connected for opening and closing toward each other, wherein said first handle comprises a first ironing surface and a second ironing surface that are permanently fixed relative to each other in orientation so that they are permanently orthogonal to each other, and wherein the second handle comprises a third ironing surface and a fourth ironing surface that are permanently fixed relative to each other in orientation so that they are permanently orthogonal to each other, so that when the first handle and the second handle are closed toward each other, the first ironing surface and the third ironing surface are moved toward each other, wherein the first ironing surface, the second ironing surface, the third ironing surface and the fourth ironing surface are each heated ironing surfaces.

10. The handheld garment care device of claim 9, wherein the first handle and the second handle are maintained in a fixed position in a steamer configuration and the first handle and the second handle are movable toward and away from one another in a creaser configuration.

11. The handheld garment care device of claim 10, wherein the first ironing surface has a plurality of steam holes and a plurality of grooves so that each of the plurality of grooves extends from one of the plurality of steam holes.

12. The handheld garment care device of claim 11, wherein, when the first and second handles are closed together in the steamer configuration, steam can still be emitted away from the first ironing surface and the second ironing surface because each of the plurality of grooves directs steam from one of the plurality of steam holes to direct the steam out even when the first and second handles are maintained in the fixed position in the steamer configuration.

13. The handheld garment care device of claim 12, wherein the same steam hole of the plurality of steam holes facilitates steam emission in either of the steamer configuration or the creaser configuration.

14. The handheld garment care device of claim 10, wherein the first handle and the second handle can be positioned on opposite sides of a garment and the first handle can be moved toward the second handle so that each of the first surface and the third surface contact the garment on opposite sides of the garment in the creaser configuration.

15. The handheld garment care device of claim 14, further comprising a lock sensor so that the creaser configuration and the steamer configuration can be detected.

16. The handheld garment care device of claim 11, wherein the third surface contacts the first surface in the steamer configuration so that the third surface covers each of the plurality of steam holes through the first surface.

17. The handheld garment care device of claim 12, wherein the second surface is adjacent the fourth surface so that at least a portion of each of the second surface and the fourth surface face the same direction to be able to contact a garment for ironing or steaming.

* * * * *